US011661928B2

(12) United States Patent
Zhu

(10) Patent No.: US 11,661,928 B2
(45) Date of Patent: May 30, 2023

(54) PISTON PUMP AND PISTON MOTOR

(71) Applicant: QINGDAO ACME INNOVATION TECHNOLOGY CO., LTD., Qingdao (CN)

(72) Inventor: Dewei Zhu, Qingdao (CN)

(73) Assignee: QINGDAO ACME INNOVATION TECHNOLOGY CO., LTD., Qingdao (CN)

( * ) Notice: Subject to any disclaimer, the term of this patent is extended or adjusted under 35 U.S.C. 154(b) by 179 days.

(21) Appl. No.: 17/263,184

(22) PCT Filed: Aug. 5, 2019

(86) PCT No.: PCT/CN2019/099161
§ 371 (c)(1),
(2) Date: Jan. 26, 2021

(87) PCT Pub. No.: WO2020/029899
PCT Pub. Date: Feb. 13, 2020

(65) Prior Publication Data

US 2021/0180576 A1 Jun. 17, 2021

(30) Foreign Application Priority Data

Aug. 6, 2018 (CN) ..... 201810887153.0

(51) Int. Cl.
*F04B 1/0452* (2020.01)
*F03C 1/34* (2006.01)
(Continued)

(52) U.S. Cl.
CPC ..... *F04B 1/0452* (2013.01); *F03C 1/0435* (2013.01); *F04B 1/053* (2013.01); *F04B 53/006* (2013.01)

(58) Field of Classification Search
CPC ..... F04B 1/04; F04B 1/0452; F04B 1/1071; F04B 1/1072; F04B 1/1075; F03C 1/053; F03C 1/0412; F03C 1/04; F03C 1/2407; F03C 1/0406; F01B 1/00; F01B 15/002; F01B 15/005; F01B 15/007; F01B 15/02;
(Continued)

(56) References Cited

FOREIGN PATENT DOCUMENTS

CN 102155367 A 8/2011
CN 204082463 U 1/2015
(Continued)

*Primary Examiner* — Kenneth J Hansen
*Assistant Examiner* — Benjamin Doyle
(74) *Attorney, Agent, or Firm* — Bayramoglu Law Offices LLC

(57) ABSTRACT

A piston pump and a piston motor are provided. The piston pump includes a cylinder body, a piston, a main shaft, an end cover, and an oil dispensing mechanism. The oil dispensing mechanism includes an oil suction mechanism and an oil discharging mechanism. A roller is mounted on the piston, and the roller is rotatablely connected to the piston. A driving wheel is arranged on the main shaft, and the driving wheel is mounted in cooperation with the main shaft or is integrally formed with the main shaft. A driving groove is formed on the driving wheel, and a roller-path surface of the driving groove is a curved surface. The size of the driving groove is adapted to the size of an outer circle of the roller. The main shaft rotates to drive the driving wheel to rotate to further drive the piston to move along the cylinder bore.

20 Claims, 27 Drawing Sheets

(51) Int. Cl.
*F04B 1/053* (2020.01)
*F04B 53/00* (2006.01)

(58) Field of Classification Search
CPC ..... F01B 13/045; F01B 13/06; F01B 13/061; F01B 13/062; F01B 13/063; F01B 13/064; F01B 13/068; F04C 23/02
USPC ..... 91/472, 491; 417/273
See application file for complete search history.

(56) References Cited

FOREIGN PATENT DOCUMENTS

| | | | |
|---|---|---|---|
| CN | 205918785 | U | 2/2017 |
| CN | 110230583 | A | 9/2019 |
| JP | 2000027754 | A | 1/2000 |
| JP | 2002227761 | A | 8/2002 |
| JP | 5627818 | B1 | 11/2014 |
| KR | 20110103652 | A | 9/2011 |

D-D

F-F

Z1-Z1

PISTON PUMP AND PISTON MOTOR

CROSS REFERENCE TO THE RELATED APPLICATIONS

This application is the national phase entry of International Application No. PCT/CN2019/099161, filed on Aug. 5, 2019, which is based upon and claims priority to Chinese Patent Application No. 201810887153.0, filed on Aug. 6, 2018, the entire contents of which are incorporated herein by reference.

TECHNICAL FIELD

The present invention relates to the field of hydraulic fluid systems, and more particularly, to a piston pump and a piston motor.

BACKGROUND

Piston pumps (motors) mainly include axial piston pumps (motors) and radial piston pumps (motors). In the prior art, the main shaft is adopted to drive the cylinder body to rotate, and by means of the spherical hinge of the sliding shoe and the piston, the sliding shoe slides on the swash plate (or stator) to drive the piston to reciprocate in the cylinder bore to complete the oil suction and discharging process. The prior art, however, has the following shortcomings: 1. complex structure and high manufacturing cost; 2. the force on the friction pair of the port plate or the pintle valve and the cylinder body (rotor) is insufficiently balanced, which causes eccentric wear, and the reliability is poor; 3. the friction pair between the sliding shoe in spherical hinge with the piston and the swash plate or the stator also is subject to wear; 4. the piston bears a relatively large lateral force, which intensifies the wear between the piston and the cylinder bore and affects the performance of the product; 5. the cylinder body (rotor) has a large moment of inertia, which is not conducive to an easy start; 6. the piston has a certain degree of rotation in the cylinder bore, which increases wear of the cylinder bore; 7. the balance of rotation is not satisfactory, the rotation is not stable enough, with high vibration and excessive noise; 8. the static-pressure balance structure of the sliding shoe is highly sensitive to the cleanliness of the oil.

SUMMARY

The objectives of the present invention is to provide a piston pump and a piston motor to solve the problems existing in the traditional piston pump and piston motor, such as complex structure, low reliability, significant eccentric wear, poor rotation balance with high vibration, excessive noise and high sensibility of the static-pressure balance structure of the sliding shoe to the cleanliness of the oil.

In order to achieve the above objectives, the present invention adopts the following technical solutions.

A piston pump includes a cylinder body, a piston, a main shaft and an end cover. The cylinder body is coaxially connected to the main shaft. The piston is mounted in a cylinder bore of the cylinder body, and is configured to move along the cylinder bore. Both ends of the cylinder body are sealed by the end cover. The piston pump further includes an oil dispensing mechanism, and the oil dispensing mechanism includes an oil suction mechanism and an oil discharging mechanism. A roller is mounted on the piston, and the roller is rotatablely connected to the piston. A driving wheel is arranged on the main shaft, and the driving wheel is mounted in cooperation with the main shaft, or is integrally formed with the main shaft. A driving groove is formed on the driving wheel, and a roller-path surface of the driving groove is a curved surface. A size of the driving groove is adapted to a size of an outer circle of the roller. The main shaft rotates to drive the driving wheel to rotate to further drive the piston to move along the cylinder bore.

Further, the oil suction mechanism employs a dispensing-by-valve mode or a dispensing-by-shaft mode, and the oil discharging mechanism also employs a dispensing-by-valve mode or a dispensing-by-shaft mode.

Further, the dispensing-by-valve mode of the oil suction mechanism is to mount an oil suction one-way valve in the piston or other positions, and the dispensing-by-valve mode of the oil discharging mechanism is to mount an oil discharging one-way valve at an oil discharging opening or other positions.

Further, supporting teeth are arranged on an inner surface of the cylinder body. The supporting teeth are configured to clamp the corresponding piston, and the piston is configured to move along surfaces of the supporting teeth.

Further, a direction of the cylinder bore is perpendicular to a direction of a center line of the cylinder body. The piston is configured to move radially along the cylinder body. The driving wheel is mounted symmetrically on both sides of the cylinder body, and the driving wheel is classified into a left driving wheel and a right driving wheel according to an installation position. The driving groove of the driving wheel includes an inner roller-path surface and an outer roller-path surface. The inner roller-path surface and the outer roller-path surface are both continuous surfaces. The continuous surface is provided with a periodic undulation formed by convex portions and concave portions which are uniformly circumferentially distributed at intervals, and the continuous surface is smoothly connected end-to-end. The inner roller-path surface and the outer roller-path surface are concentrically nested together at an equal spacing, and the size of the spacing is adapted to an outer diameter of the roller. The roller is left-to-right symmetrically arranged on both sides of the piston, and is correspondingly separately fitted in the driving groove of each of the left driving wheel and the right driving wheel. The roller is clamped between the inner roller-path surface and the outer roller-path surface to roll along the driving groove. A housing is further mounted outside the cylinder body, and the housing is provided with an oil discharging opening. The oil inlet opening is located on the main shaft or other positions. The main shaft is supported on the housing, the end cover or the cylinder body through a bearing.

Further, a direction of the cylinder bore is parallel to a direction of a center line of the cylinder body, and the cylinder bodies are left-to-right symmetrically arranged. In case of left-to-right symmetrical arrangement, cylinder bores of the left cylinder body and the right cylinder body are communicated in one-to-one correspondence. The piston is configured to move in the corresponding communicated cylinder bores. Each piston together with the corresponding left and right cylinder bores is capable of forming two operating chambers on the left and right to perform the oil suction and the oil discharging at a same time. When one operating chamber is configured to perform the oil suction, the corresponding operating chamber on the other side is configured to perform the oil discharging. The two operating chambers are configured to alternately apply work to complete the oil pumping process. Both ends of the housing are sealed by the end cover. An oil suction opening and an oil discharging opening are both arranged on the main shaft, and communicate with the cylinder bores, respectively. The driving wheel and the main shaft are integrally formed. A position of the driving groove corresponds to the supporting teeth. The driving groove is a closed groove circumferentially surrounding the driving wheel, and a width and a depth of the driving groove are adapted to the roller. The roller is located on a side of the piston, and the roller is configured to move along the driving groove.

As needed actually, the above-mentioned two cylinder bodies arranged left-to-right symmetrically may also be set as a single cylinder body, and other parts are changed correspondingly, which will not be described in detail here.

Further, a cylinder body sleeve is further mounted between the cylinder bodies that are left-to-right symmetrically arranged, and the supporting teeth are arranged on the cylinder body sleeve or the cylinder bodies.

Further, piston includes a supporting beam and a piston body. The piston body and the supporting beam are perpendicular to form a T-shape or a cross-shape. The piston body and the supporting beam are assembled by connecting each other or are integrally formed, and the roller is mounted on the supporting beam.

Further, a guiding sleeve is arranged on the supporting beam. When the piston moves in the cylinder bore, the guiding sleeve moves along the supporting teeth to reduce wear on the supporting beam.

Further, a wear-resisting ring is provided at an upper end of the piston body to facilitate maintenance and replacement, and a static-pressure supporting groove is further arranged on a side of the piston to provide a static-pressure support to the piston to reduce wear. The static-pressure supporting groove may communicate with the cylinder bore through a static-pressure bore.

Further, the dispensing-by-shaft mode of the oil suction mechanism is to arrange an oil suction groove on an outer circular surface of a left driving wheel. The oil suction groove communicates with an inner chamber of the piston pump. A cylinder oil suction channel corresponding to each cylinder bore is arranged in the cylinder body. A housing oil channel is formed in the housing. The cylinder oil suction channel communicates with the cylinder bore through the housing oil channel. The cylinder oil suction channel and the cylinder bore can also communicate with each other in the cylinder body.

Further, the dispensing-by-shaft mode of the oil discharging mechanism is that the oil discharging grooves are arranged correspondingly and uniformly on an outer circular surface of a right driving wheel. The outer circular surface of the driving wheel is matched with an inner circular surface of the cylinder body. A first cylinder oil discharging channel and a second cylinder oil discharging channel corresponding to each cylinder bore are uniformly arranged on the cylinder body, and the driving wheel is configured to switch on/off a connection between the first cylinder oil discharging channel and the second cylinder oil discharging channel through the outer circular surface and the oil discharging groove. When the oil discharging groove on the outer circular surface of the driving wheel runs to a position aligned with the first cylinder oil discharging channel and the second cylinder oil discharging channel, the first cylinder oil discharging channel and the second cylinder oil discharging channel are connected through the oil discharging groove to realize oil discharging of the piston pump; otherwise, an oil opening of the first cylinder oil discharging channel and an oil opening of the second cylinder oil discharging channel are closed by the outer circular surface of the driving wheel, the connection between the first cylinder oil discharging channel and the second cylinder oil discharging channel is switched off, and a pump oil discharging opening is closed in cooperation with oil suction process of the piston pump.

Further, an oil suction groove and an oil discharging groove are arranged on the main shaft. The oil suction groove communicates with a pump oil suction opening through an oil suction channel inside the main shaft, and the oil discharging groove communicates with a pump oil discharging opening through an oil discharging channel inside the main shaft. The cylinder oil channel is arranged on the end cover, and the cylinder oil channel communicates with the corresponding cylinder bore. When the main shaft rotates, the oil suction groove communicates with the corresponding cylinder bore through the corresponding cylinder oil channel, and the oil discharging groove communicates with the corresponding cylinder bore through the corresponding cylinder oil channel, to cooperate with each other to complete an oil suction and discharging process.

A piston motor is provided, and the structure of a driving mechanism of the piston motor is identical to the structure of a driving mechanism of any piston pump mentioned above. A pump oil discharging opening of the piston pump is used as an oil inlet opening of the piston motor into which high-pressure oil is pumped, and a dispensing-by-shaft mode of the piston pump is used to control the high-pressure oil to timely enter each cylinder bore and drive the piston to move in the cylinder bore to further drive the main shaft to rotate and output power. A pump oil suction opening of the original piston pump is used as an oil returning opening of the piston motor, and the dispensing-by-shaft mode or dispensing-by-valve mode of the piston pump is used to cooperate with a movement of the piston to control an oil returning of the hydraulic oil in the cylinder bore to realize a function of the piston motor.

The present invention has the following advantages.

The technical solutions of the present invention abandon the traditional model of the sliding shoe drive, and has a simple and reliable structure to reduce the sensitivity to the cleanliness of the oil. The components have high rotating balance and stable rotation, thereby solving the problems of poor rotation balance, insufficiently stable rotation, and low reliability of the dispensing friction pair and the sliding shoe friction pair in the prior art. Moreover, the cylinder body and the piston do not rotate to reduce the moment of inertia, which makes the motor an easy start. Additionally, the supporting teeth are set to reduce the lateral force between the sliding engaging surface of the piston and the cylinder bore, while eliminating the problems caused by the rotation of the piston, thereby reducing the wear of the cylinder bore and improving the reliability of the product.

Figure 1:
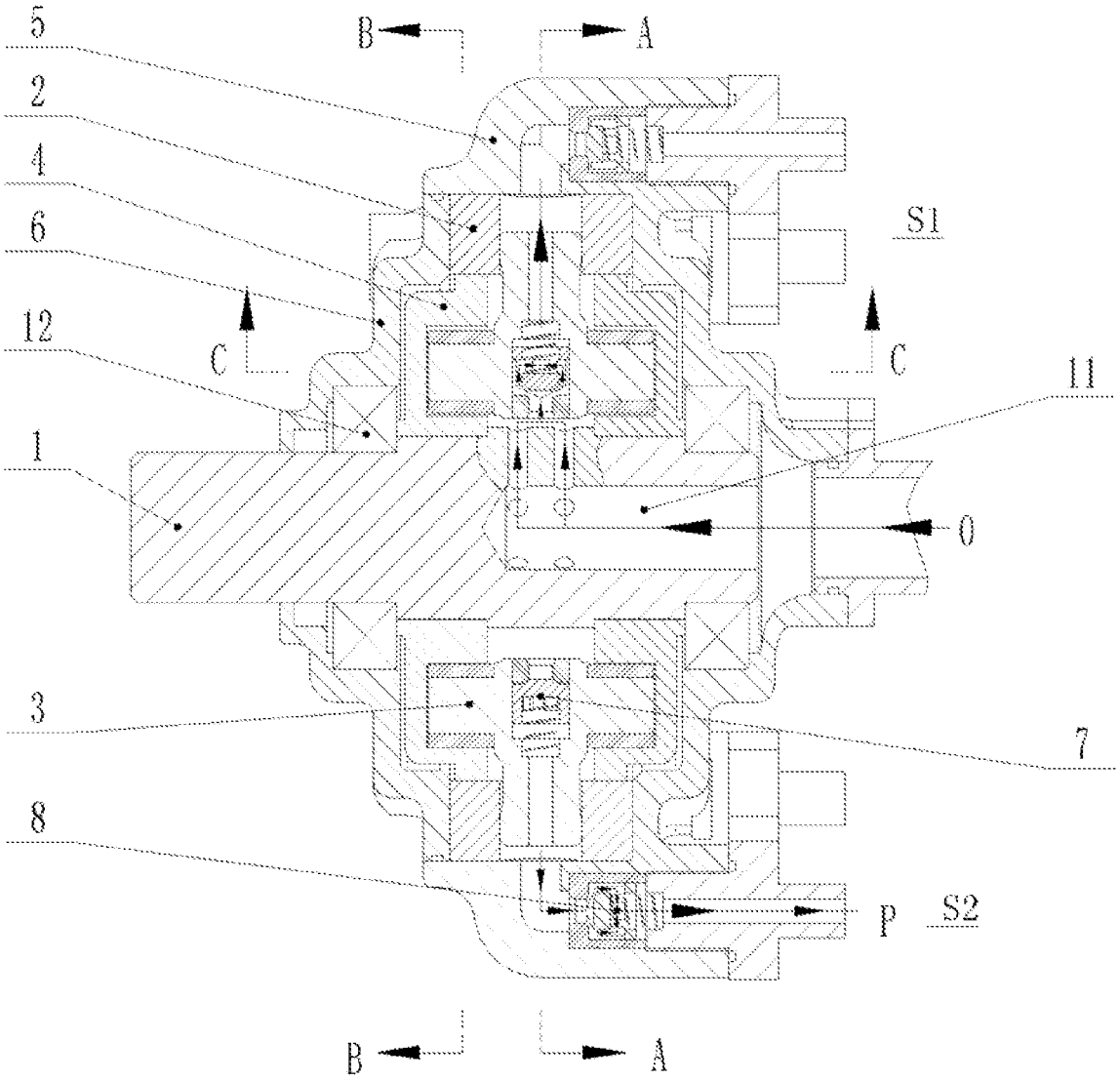
FIG. 1 is a schematic diagram of the structure according to an Embodiment 1.

In the figures: 1. main shaft; 11. oil inlet channel; 12. bearing; 13. oil suction channel; 14. oil discharging channel; 2. cylinder body; 21. cylinder bore; 22. supporting teeth; 23. cylinder oil suction channel; 24. first cylinder oil discharging channel; 25. second cylinder oil discharging channel; 26. cylinder oil channel; 27. cylinder body sleeve; 3. piston; 31. guiding surface; 32. roller; 33. piston bore; 34. sliding engaging surface; 35. piston body; 36. supporting beam; 37. guiding sleeve; 38. wear-resisting ant ring; 39. static-pressure supporting groove; 391. static-pressure bore; 4. driving wheel; 41. driving groove; 411. inner roller-path surface; 412. outer roller-path surface; 42. spline; 43. left driving wheel; 431. oil suction groove; 44. right driving wheel; 441. oil discharging groove; 5. housing; 51. housing oil channel; 6. end cover; 7. oil suction one-way valve; 8. oil discharging one-way valve.

DETAILED DESCRIPTION OF THE EMBODIMENTS

The present invention will be further described below in conjunction with the drawings.

Embodiment 1

As shown in FIGS. 1-8F, a piston pump of the present invention includes the main shaft 1, the housing 5, the cylinder body 2, the driving wheel 4, the piston 3, the end cover 6, the oil suction one-way valve 7 and the oil discharging one-way valve 8. The main shaft is provided with the oil inlet channel 11, and the main shaft is supported on the housing and the end cover through the bearing 12. A pump chamber is formed between the housing and the end cover. An outer circular surface of the cylinder body is matched with an inner circular surface of the housing, and the cylinder body is clamped and fixed in the housing by the housing and the end cover. The cylinder body is provided with a plurality of radial cylinder bores 21 uniformly distributed circumferentially, and the present embodiment uses eight cylinder bores as an example. Accordingly, one piston is correspondingly mounted in each cylinder bore, and the sliding engaging surface 34 of each piston is correspondingly fitted in the corresponding cylinder bore to form an operating unit. Two driving wheels are symmetrically assembled on both sides of the cylinder bore, and are connected to the main shaft through the spline 42.

Figure 4:
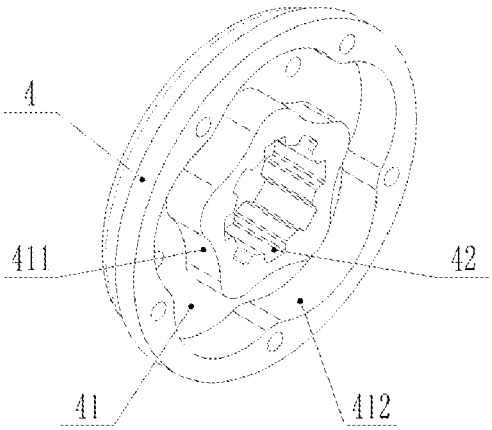
FIG. 4 is a perspective view of the structure of the driving wheel according to Embodiment 1.

As shown in FIG. 4, the driving groove 41 is provided on the driving wheel, and the driving groove has the inner roller-path surface 411 and the outer roller-path surface 412. The inner roller-path surface and the outer roller-path surface are continuous surfaces. The continuous surface is provided with a periodic undulation formed by convex portions and concave portions which are uniformly circumferentially distributed at intervals, and the continuous surface is smoothly connected end-to-end. The inner roller-path surface and the outer roller-path surface are concentrically nested together at an equal spacing, and the size of the spacing is adapted to the outer diameter of the roller. The two rollers 32 left-to-right symmetrically arranged on the piston are correspondingly fitted in the driving grooves of the left driving wheel and the right driving wheel, respectively. The roller is clamped between the nested inner and outer roller-path surfaces, can roll along the inner and outer roller-path surfaces, and is restricted by the inner and outer roller-path surfaces.

Figure 5:
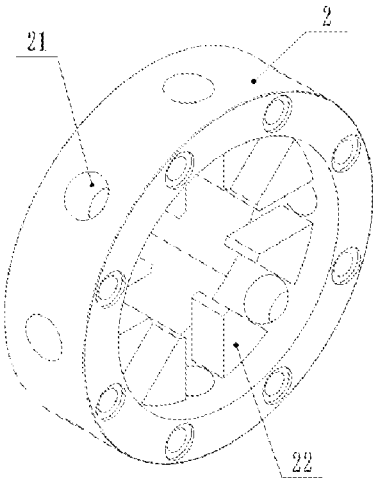
FIG. 5 is a perspective view of the structure of the cylinder body according to Embodiment 1.
Figure 6A:
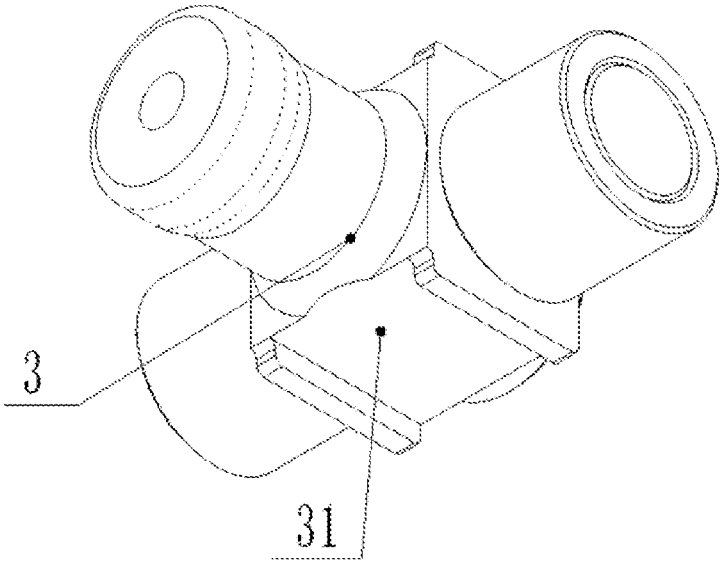
FIG. 6A is a perspective view of the structure of the piston according to Embodiment 1.
Figure 6B:
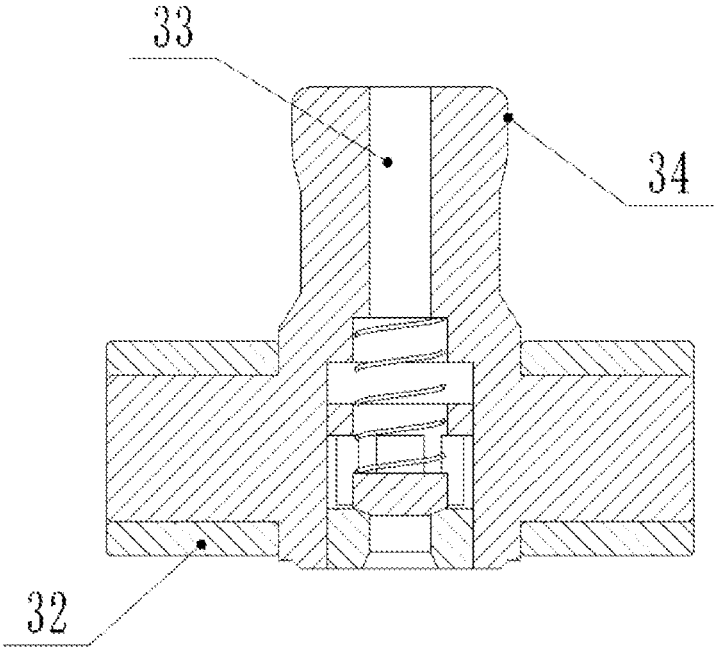
FIG. 6B is a cross-sectional view of the structure of the piston according to Embodiment 1.
Figure 7A:
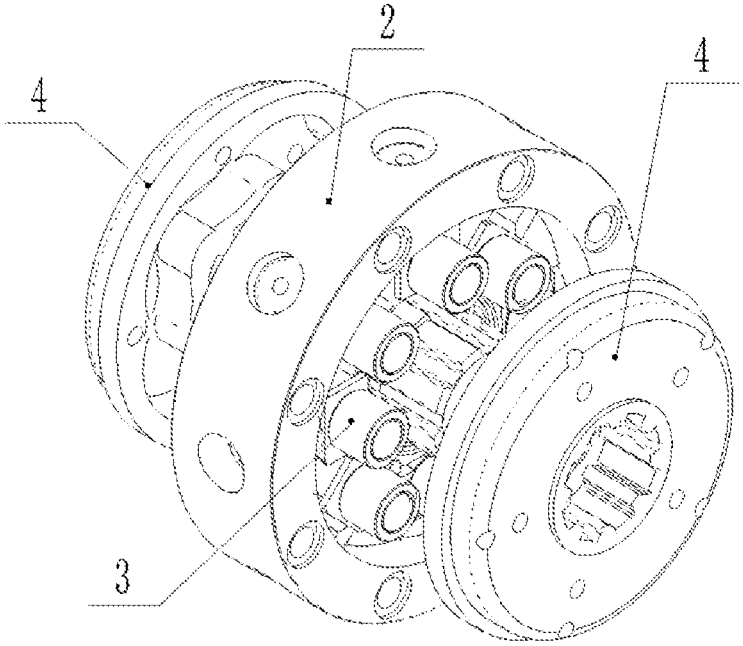
FIG. 7A is a schematic diagram showing the installation of the driving wheel and the piston according to Embodiment 1.
Figure 7B:
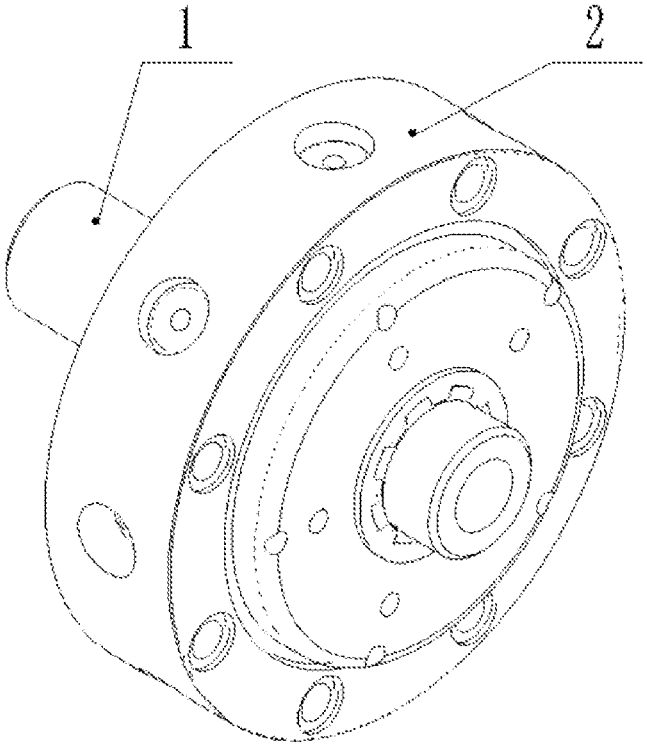
FIG. 7B is a schematic diagram showing the installation of the driving wheel and the cylinder body according to Embodiment 1.
Figure 8A:
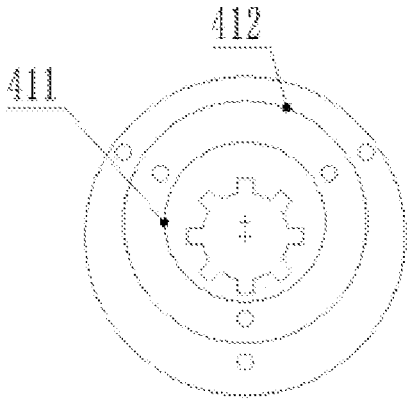
FIG. 8A-FIG. 8F are schematic diagrams showing the shape of the driving groove of the driving wheel.
Figure 8B:
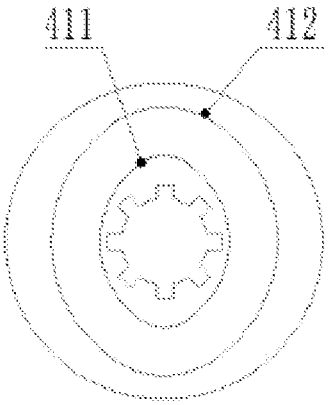
Figure 8C:
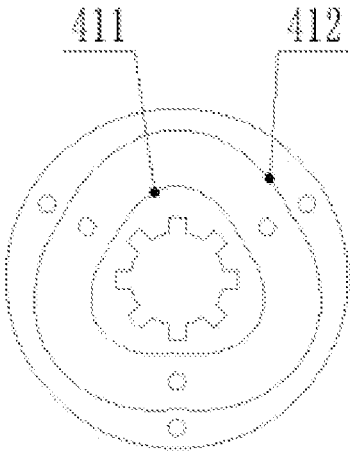
Figure 8D:
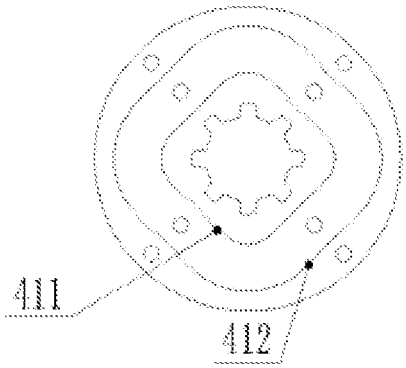
Figure 8E:
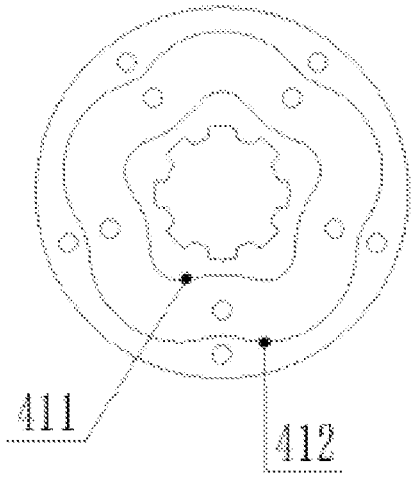
Figure 8F:
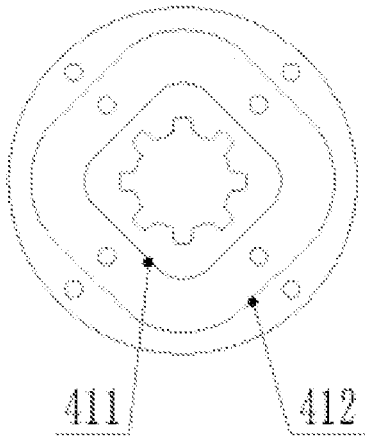

As shown in FIG. 5, the cylinder body is further provided with the supporting teeth 22 corresponding to the cylinder bores. As shown in FIG. 6A, the piston is provided with the guiding surface 31 corresponding to the supporting teeth. The piston is clamped between two adjacent supporting teeth by the guiding surface, and the guiding surface of the piston may slide along the surfaces of the supporting teeth. The supporting teeth provide support and movement guidance for the piston, and can bear the lateral force acting on the piston. And meanwhile, the supporting teeth restrict the rotational freedom of the piston around the axis of the cylinder bore to enable the sliding engaging surface of the piston to match with the cylinder bore to only slide in the cylinder bore along the axial direction of the cylinder bore and not rotate. When the main shaft drives the driving wheel to rotate, the rollers roll in the driving groove, and the axis of the roller is maintained to be parallel to the axis of the main shaft, at the same time, the distance between the axis of the roller and the axis of the main shaft is changed correspondingly with the periodic undulation change of the inner and outer roller-path surfaces. As a result, the piston is driven to perform corresponding periodic reciprocating movement in the radial cylinder bore, and the oil suction and discharging process is completed with the cooperation of the oil dispensing mechanism.

The oil dispensing manner of the present embodiment is a dispensing-by-valve mode, as shown in FIG. 1, an oil dispensing mechanism includes an oil suction one-way valve and an oil discharging one-way valve. Each cylinder bore and the corresponding piston constitute an operating unit, and one oil suction one-way valve and one oil discharging one-way valve are arranged correspondingly. The oil suction one-way valve is arranged in the corresponding piston bore 33, and the oil discharging one-way valve is arranged on the housing oil channel 51 corresponding to the cylinder bore. The oil discharging one-way valve communicates with the corresponding oil discharging opening. When the operating unit is in the oil suction stage, the hydraulic oil is pumped into the pump chamber from the pump oil suction opening, then pushes and opens the oil suction one-way valve of the corresponding operating unit, and enters the corresponding cylinder bore through the oil inlet bore of the corresponding piston, so as to complete the oil suction process of the operating unit. At the same time, during the oil suction process, the corresponding oil discharging one-way valve of the operating unit is correspondingly closed. When the operating unit is in the oil discharging stage, the hydraulic oil is forced by the compression of the corresponding piston into the corresponding housing oil channel through the corresponding cylinder bore, then pushes and opens the corresponding oil discharging one-way valve, and is supplied to the outside through the pump oil discharging opening, so as to complete the oil discharging process of the operating unit. At the same time, during the oil discharging process, the corresponding oil suction one-way valve of the operating unit is correspondingly closed. FIG. 1 shows separately the oil suction process of the operating unit S1 from the pump oil suction opening O and the oil discharging process of the operating unit S2 through the pump oil discharging opening P by using arrows, and the arrows indicate the flow direction of the hydraulic oil, which will not be described in detail here.

The driving principle of the driving wheel is as follows.

Figure 2A:
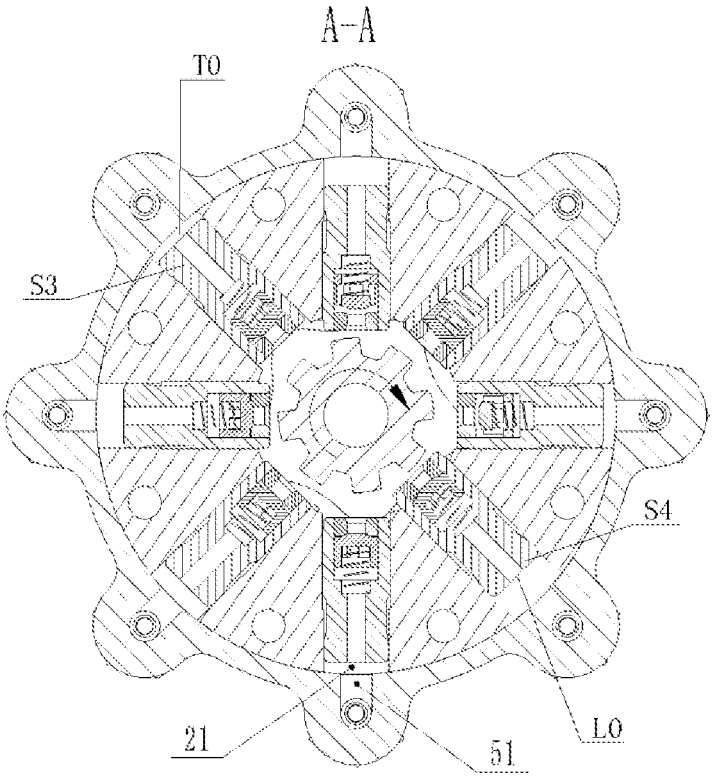
FIG. 2A is a cross-sectional view of FIG. 1 along the A-A direction.
Figure 2B:
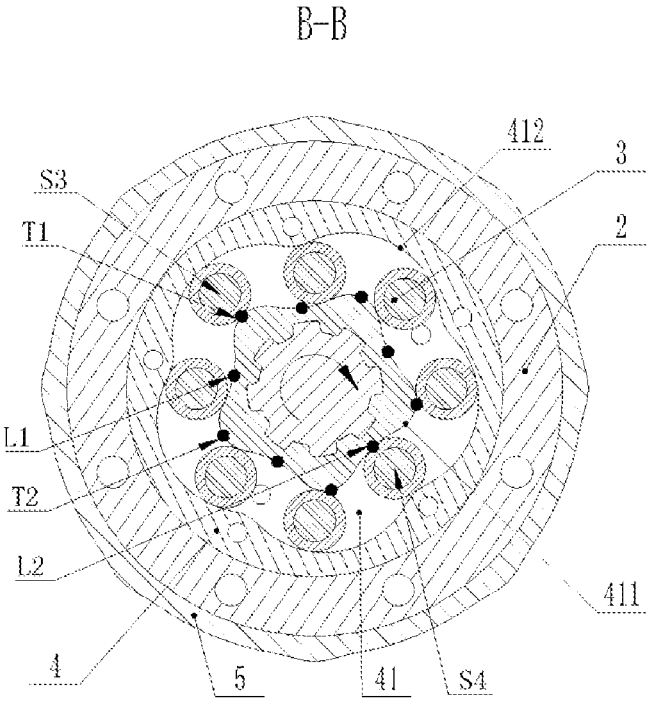
FIG. 2B is a cross-sectional view of FIG. 1 along the B-B direction.
Figure 3:
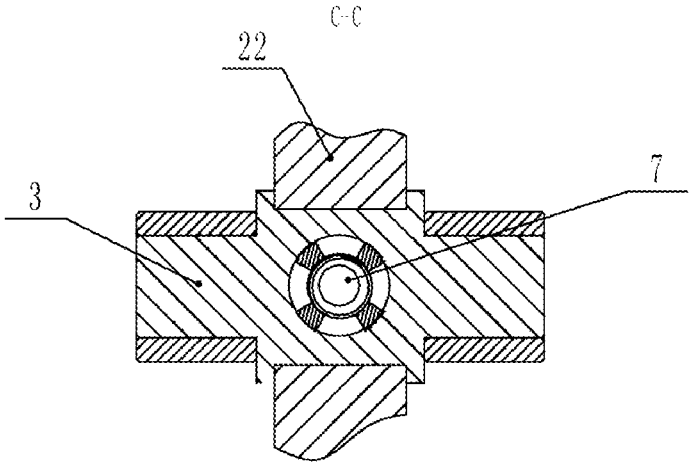
FIG. 3 is a cross-sectional view of FIG. 1 along the C-C direction.

As shown in FIG. 2A and FIG. 2B, the main shaft drives the driving wheel to rotate clockwise, forcing the roller of the piston to roll in the driving groove, and at the same time, the roller is forced through the inner and outer roller-path surfaces to make adaptive changes in position with the periodic convexo-concave undulation of the inner and outer roller-path surfaces. As a result, the piston is driven to gradually move away from or close to the center of the main shaft, and the sliding engaging surface of the piston is enabled to periodically reciprocate in the cylinder bore. The B-B view of FIG. 2 B shows a schematic diagram of the position of each roller of the piston at a certain moment when rolling in the driving groove, and the black dots mark the top points of the convex portions and the lowest points of the concave portions of the inner roller-path surface of the driving groove. The A-A view of FIG. 2A shows the corresponding position of each piston in the corresponding cylinder bore at the corresponding moment. Specifically, the roller of the piston S3 is exactly at the top point T1 of the convex portion of the inner roller-path surface, the piston at this position is at the farthest distance from the center of the main shaft, and the piston moves to the top dead center position T0 of its stroke. The roller of the piston S4 is exactly at the lowest point L2 of the concave portion of the inner roller-path surface, and the piston at this position is correspondingly at the closest distance to the center of the main shaft, and the piston moves to the lower dead center position L0 of its stroke. During the continuous rotation of the driving wheel, the roller of the piston always follows the periodic undulation change of the roller-path surface and continuously rolls between the top points and the lowest points of the roller-path surface, so that the corresponding piston is driven to continuously perform corresponding periodic reciprocating movement between the top dead center position and the low dead center position of its stroke, so as to realize the periodic oil suction and discharging of the pump. The piston performs the oil suction process when moving from the top dead center position to the lower dead center position, and then performs the oil discharging process when moving from the lower dead center position to the top dead center position, and one continuous process of oil suction and oil discharging constitutes one operating cycle. For example, as shown in the B-B view of FIG. 2B, when the roller of the piston rolls successively through the three points T1, L1, T2 as the driving wheel rotates, the corresponding piston completes one operating cycle. The oil suction process is from T1 to L1, and the oil discharging process is from L1 to T2. The number of operating cycles of the piston in one rotational cycle of the driving wheel depends on the number of the top points of the convex portions and the number of the lowest points of the concave portions of the roller-path surface. The present embodiment exemplifies the case where each of the number of the top points of the convex portions and the number of the lowest points of the concave portions of the roller-path surface is five, so each piston can be driven to complete five operating cycles in one rotational cycle of the driving wheel.

Apparently, there are many manners to arrange the inner and outer roller-path surfaces of the driving groove, FIG. 8A-FIG. 8F show several preferred arrangement solutions. Referring to the example given in FIG. 8A, the cross-sectional contour shapes of the inner and outer roller-path surfaces are concentric circles eccentric to a certain distance, and the driving wheel rotates one circle to drive the piston to complete one operating cycle. Referring to the example given in FIG. 8B, the inner and outer roller-path surfaces are elliptical surfaces, and the driving wheel rotates one circle to drive the piston to complete two operating cycles. Referring to the examples given in FIG. 8C, FIG. 8D and FIG. 8E, the roller-path surfaces are continuous curved surfaces formed by the smooth connection of several $r_1/r_2$ arc surfaces, and the driving wheel rotates one circle to drive the piston to complete three, four, and five operating cycles, respectively. Referring to the example given in FIG. 8F, the cross-sectional contour shape of the roller-path surfaces is formed through the smooth connection of four $r_1$ arcs by using four straight segments Y. and the driving wheel rotates one circle to drive the piston to complete four operating cycles. The above-mentioned arc surfaces of $r_1$ and $r_2$ can also be transformed into other different roller-path surfaces of the driving groove that are formed by the smooth connection of curved surfaces or planes of different shapes and different numbers, which will not be described in detail here.

The rollers can be arranged reasonably as needed, and can be bearings, bearing bushes, bearing sleeves or other rolling structures.

The discharge quantity of the pump can be adjusted by changing the size of the cylinder bore, increasing or reducing the number of cylinder bores, changing the contour shape of the roller-path surface of the driving wheel, or other manners, so as to derive different specifications and models, and several pumps can also be used in series.

The above operating unit formed by each piston and the corresponding cylinder bore can be used as a separate unit pump, and can also be combined with other operating units to connect the corresponding pump oil discharging opening to supply oil to the outside, so as to form different usage schemes, which will not be described in detail here.

Embodiment 2

Figure 9:
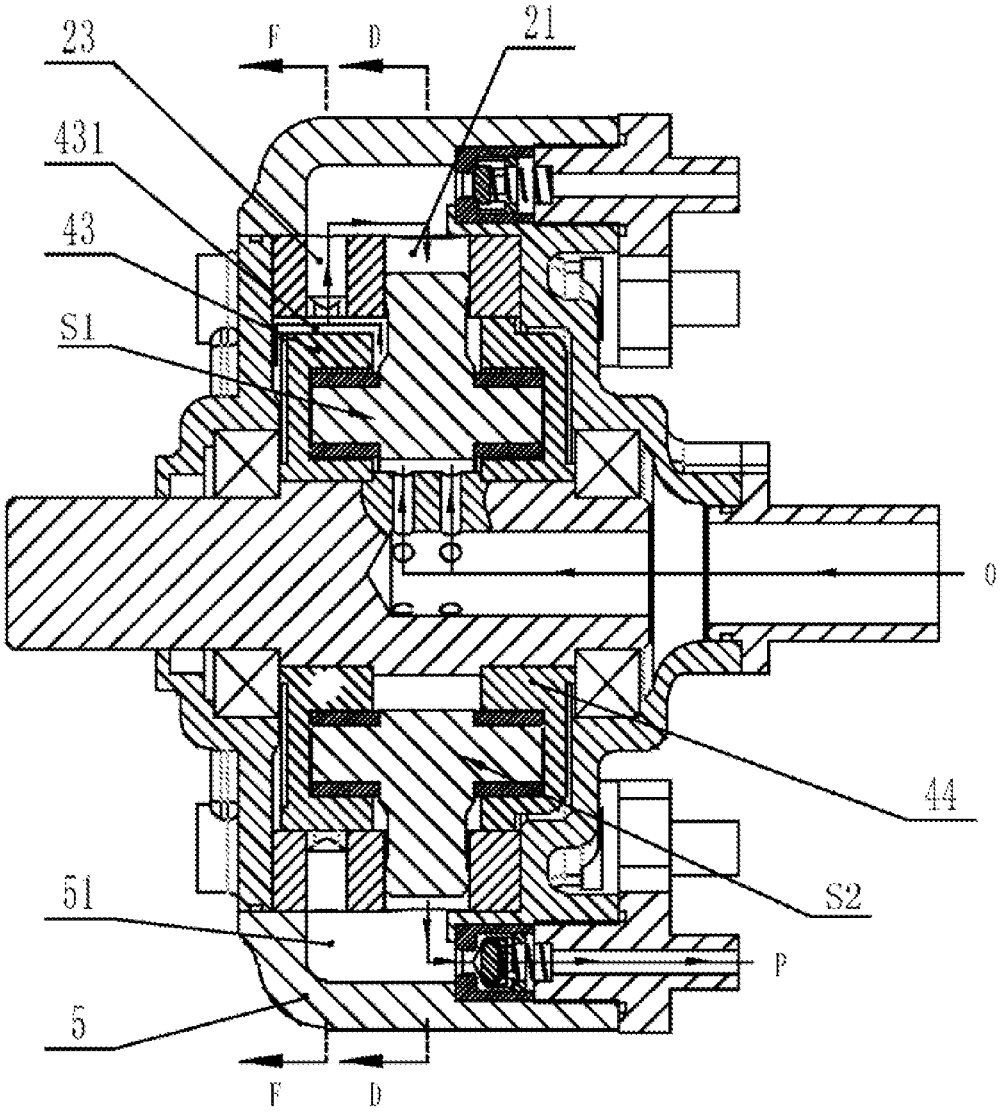
FIG. 9 is a schematic diagram of the structure according to Embodiment 2.
Figure 10A:
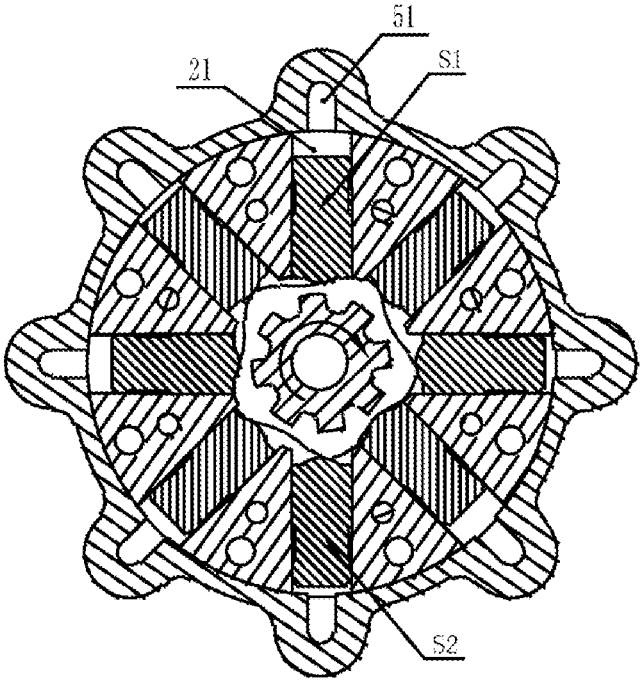
FIG. 10A is a cross-sectional view of FIG. 9 along the D-D direction.
Figure 10B:
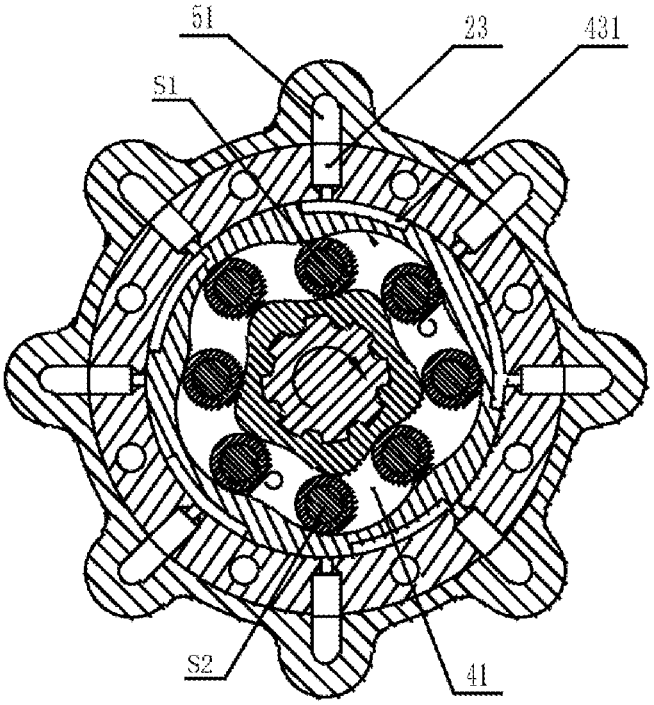
FIG. 10B is a cross-sectional view of FIG. 9 along the F-F direction.

FIG. 9 is a front view according to Embodiment 2, compared with Embodiment 1, the main differences are: in the oil dispensing mechanism according to Embodiment 1, both the oil suction dispensing and the oil discharging dispensing use the dispensing-by-valve mode, while the oil dispensing mechanism of Embodiment 2 uses a hybrid dispensing mode of dispensing-by-shaft+dispensing-by-valve. The specific changes are: in Embodiment 2, the oil suction dispensing in Embodiment 1 is changed from the dispensing-by-valve mode to the dispensing-by-shaft mode, the oil suction one-way valve in the piston is removed, and the structure of the driving wheels on both sides of the cylinder is also different. The outer circular surface of the left driving wheel 43 is uniformly provided with oil suction grooves 431 communicating with the pump chamber, and the outer circular surface of the driving wheel is matched with the inner circular surface of the cylinder body. Meanwhile, the cylinder oil suction channel 23 corresponding to each cylinder bore is uniformly arranged on the inner circular surface of the cylinder body, and communicates with the corresponding cylinder bore through the housing oil channel 51. During the rotation of the driving wheel, the oil suction groove and the outer circular surface of the driving wheel timely control the opening and closing of the corresponding cylinder oil suction channel to cooperate with the piston to perform the oil suction and discharging, so as to realize the oil suction and discharging process of the piston through cooperation. FIG. 9 shows separately the oil suction process of the operating unit S1 from the pump oil suction opening O and the oil discharging process of the operating unit S2 through the pump oil discharging opening P by using arrows. When the operating unit S1 performs the oil suction, the hydraulic oil enters the pump chamber from the pump oil suction opening O, then enters the cylinder oil suction channel through the oil suction groove of the driving wheel, and then enters the corresponding cylinder bore through the housing oil channel. When the operating unit S2 performs the oil discharging, the cylinder oil suction channel corresponding to the operating unit S2 is closed by the outer circular surface of the driving wheel, so that the channel between the cylinder bore and the pump chamber is cut off, while the compressed hydraulic oil opens the corresponding oil discharging one-way valve to be discharged from the pump oil discharging opening P. The F-F view of FIG. 10B shows the state of cooperation between the oil suction groove and the outer circular surface of the driving wheel and each cylinder oil suction channel at a certain moment, and the D-D view of FIG. 10A is the position of each piston in the corresponding cylinder bore at this moment. In the figures, the cylinder oil suction channel of the operating unit in the oil suction state communicates with the oil suction groove of the driving wheel, while the cylinder oil suction channel of the operating unit in the oil discharging state is closed by the outer circular surface of the driving wheel, and does not communicate with the oil suction groove of the driving wheel. Other operating principles are similar to that of Embodiment 1, and will not be described in detail here.

Embodiment 3

Figure 11:
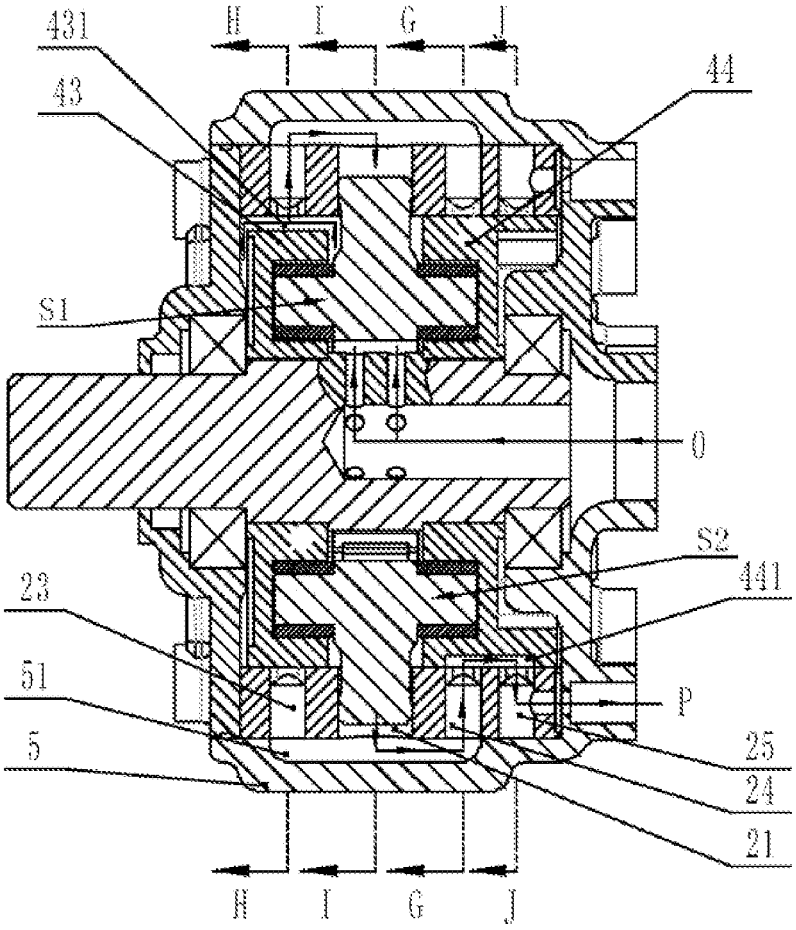
FIG. 11 is a schematic diagram of the structure according to Embodiment 3.
Figure 12:
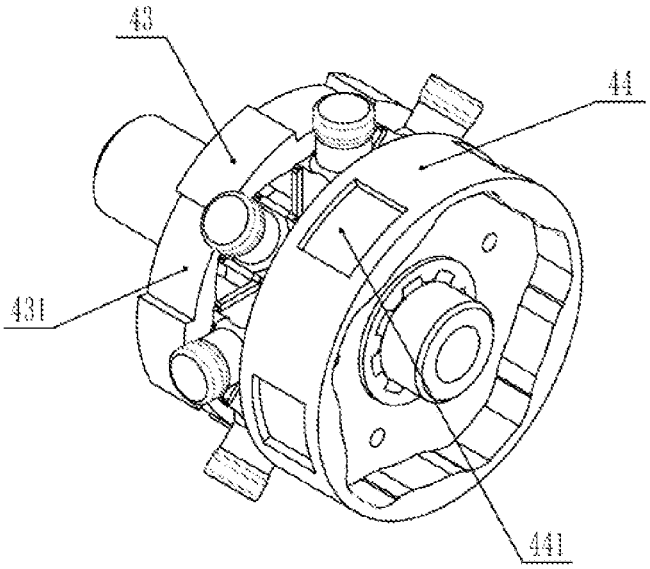
FIG. 12 is a schematic diagram of the structure of the oil suction groove and the oil discharging groove according to Embodiment 2 and Embodiment 3.

FIG. 11 is a front view according to Embodiment 3, compared with Embodiment 2, the main differences are: the oil discharging dispensing of Embodiment 2 adopts a dispensing-by-valve mode, while in Embodiment 3, the oil discharging dispensing of Embodiment 2 is changed from the dispensing-by-valve mode to a dispensing-by-shaft mode. The specific changes are: the oil discharging one-way valve in the housing is removed, correspondingly, as shown in FIG. 12, the oil discharging grooves 441 are correspondingly and uniformly arranged on the outer circular surface of the right driving wheel 44, and the outer circular surface of the right driving wheel is matched with the inner circular surface of the cylinder body. Meanwhile, the first cylinder oil discharging channel 24 and the second cylinder oil discharging channel 25 corresponding to each cylinder bore are uniformly arranged on the inner circular surface of the cylinder body. The first cylinder oil discharging channel communicates with the corresponding cylinder bore through the corresponding housing oil channel, and the second cylinder oil discharging channel communicates with the corresponding pump oil discharging opening. During the rotation of the right driving wheel, in cooperation with the oil suction and discharging process of the piston, the oil discharging groove and the outer circular surface of the right driving wheel timely control the opening and closing of the first cylinder oil discharging channel and the second cylinder oil discharging channel of the corresponding cylinder body, so as to realize the oil suction and discharging process of the piston through cooperation. FIG. 11 shows separately the oil suction process of the operating unit S1 from the pump oil suction opening O and the oil discharging process of the operating unit S2 through the pump oil discharging opening P by using arrows. When the operating unit S1 performs the oil suction, the hydraulic oil enters the pump chamber from the pump oil suction opening O, then enters the corresponding cylinder oil suction channel through the oil suction groove of the left driving wheel, and then enters the corresponding cylinder bore through the corresponding housing oil channel. At the same time, the outer circular surface of the right driving wheel correspondingly closes the first cylinder oil discharging channel and the second cylinder oil discharging channel of the corresponding cylinder bore, thereby cutting off the oil discharging channel of the corresponding cylinder bore, and cooperating to complete the oil suction process of the operating unit S1. When the operating unit S2 performs the oil discharging, the cylinder oil suction channel corresponding to the operating unit S2 is closed by the outer circular surface of the left driving wheel, thereby cutting off the channel between the corresponding cylinder bore and the pump chamber. Meanwhile, the oil discharging groove of the right driving wheel connects the first cylinder oil discharging channel and the second cylinder oil discharging channel of the operating unit S2, and the compressed hydraulic oil is discharged from the pump oil discharging opening P through the housing oil channel, the first cylinder oil discharging channel and the second cylinder oil discharging channel.

Figure 13A:
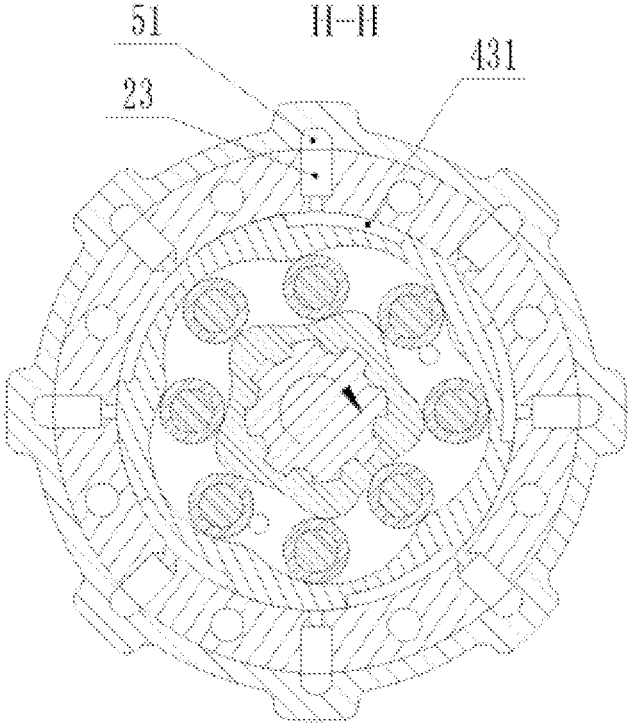
FIG. 13A is a cross-sectional view of FIG. 11 along the H-H direction.
Figure 13B:
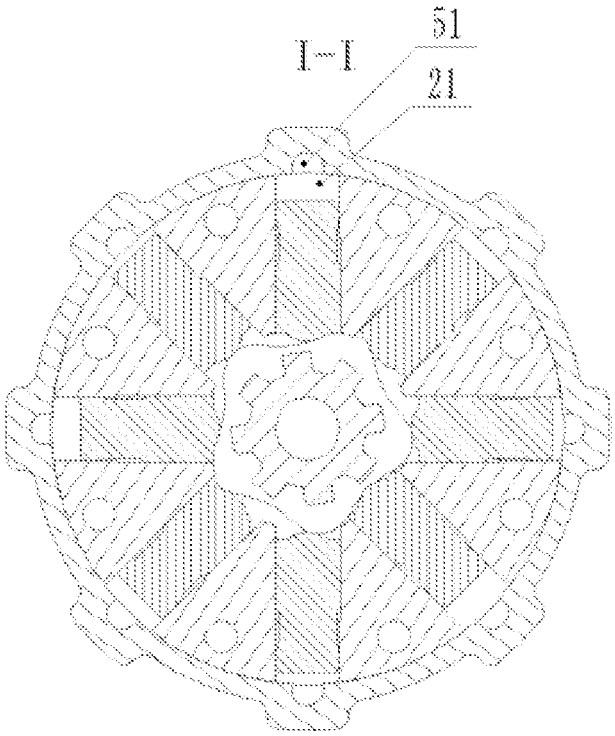
FIG. 13B is a cross-sectional view of FIG. 11 along the I-I direction.
Figure 13C:
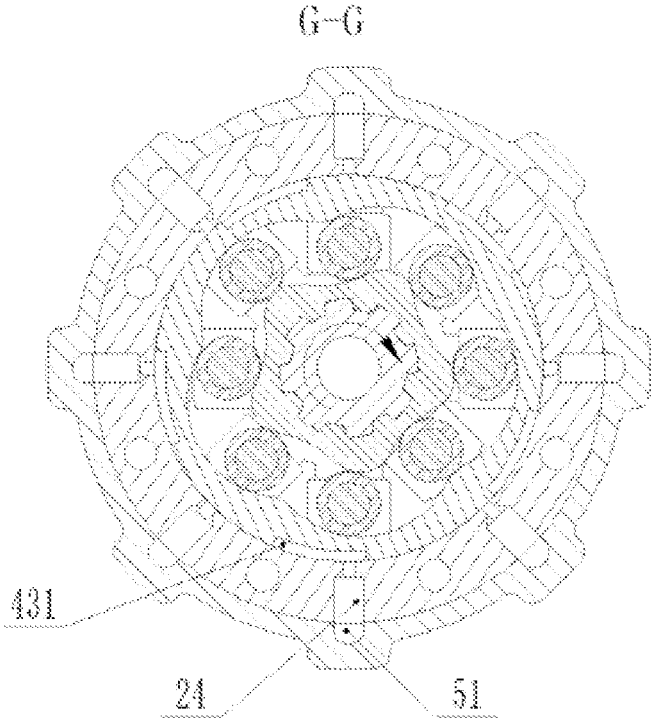
FIG. 13C is a cross-sectional view of FIG. 11 along the G-G direction.
Figure 13D:
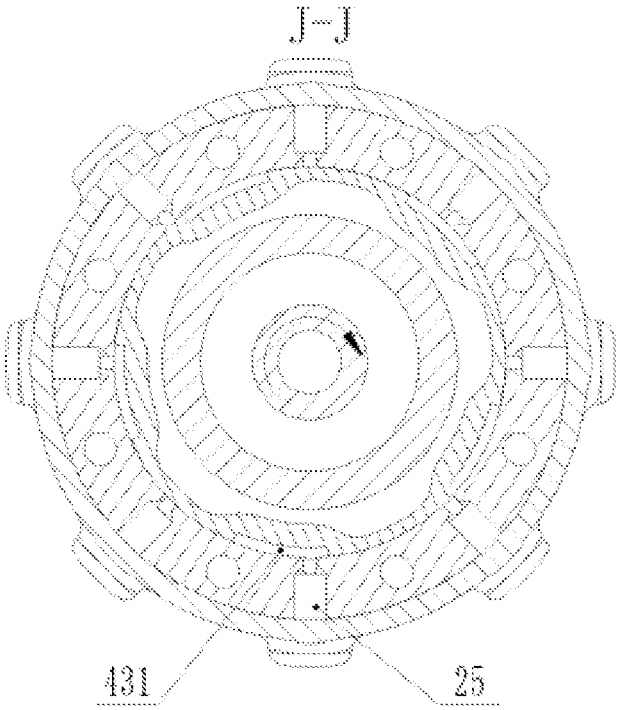
FIG. 13D is a cross-sectional view of FIG. 11 along the J-J direction.

FIGS. 13A-13D show the states of cooperation between the cylinder bore, the cylinder oil suction channel, the first cylinder oil discharging channel and the second cylinder oil discharging channel of the cylinder body, the oil suction groove of the left driving wheel, and the oil discharging groove of the right driving wheel at the operating moment shown in FIG. 11. The H-H view of FIG. 13A shows the state of cooperation between the oil suction groove and the outer circular surface of the left driving wheel and each cylinder oil suction channel, and the G-G view of FIG. 13C and the J-J view of FIG. 13D show the state of cooperation between the oil discharging groove and the outer circular surface of the right driving wheel and the first cylinder oil discharging channel and second cylinder oil discharging channel of each cylinder body. The I-I view of FIG. 13B shows the position of each piston in the corresponding cylinder bore in this state. In the figures, the cylinder oil suction channel of the operating unit in the oil suction state communicates with the oil suction groove of the left driving wheel. Concurrently, the corresponding first cylinder oil discharging channel and second cylinder oil discharging channel are closed by the outer circular of the right driving wheel, thereby cutting off the oil discharging channel of the operating unit. The first cylinder oil discharging channel and the second cylinder oil discharging channel of the operating unit in the oil discharging state are connected by the oil discharging groove of the right driving wheel, and the oil discharging channel is opened, correspondingly, the cylinder oil suction channel is closed by the outer circular surface of the left driving wheel, and the oil suction channel is closed. FIG. 12 is a perspective view showing the assembly position of the main shaft and the left and right driving wheels. FIG. 11 shows the liquid flow route of the oil suction process of the operating unit S1 and the liquid flow route of the oil discharging process of the operating unit S2 by using arrows. Other operating principles are similar to that of Embodiment 2 and will not be described in detail here.

By changing the oil supply method, the piston pump of the present invention can also be used as a motor. When the pump oil discharging opening is used as the oil inlet opening of the motor into which the high-pressure oil is pumped, and the original pump oil suction opening is used as the oil returning opening of the motor, then the piston pump can be changed into a piston motor. The piston can reciprocate in the cylinder bore under the action of high-pressure oil to drive the driving wheel to rotate, to further drive the main shaft to rotate and output the power. The action process of the piston motor is opposite to that of the pump, which will not be described in detail here.

Embodiment 4

Figure 14A:
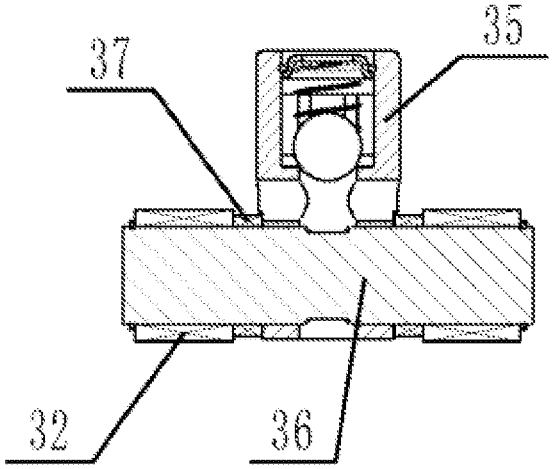
FIG. 14A-FIG. 14D are schematic diagrams of the structure of a split-type piston according to Embodiment 4.
Figure 14B:
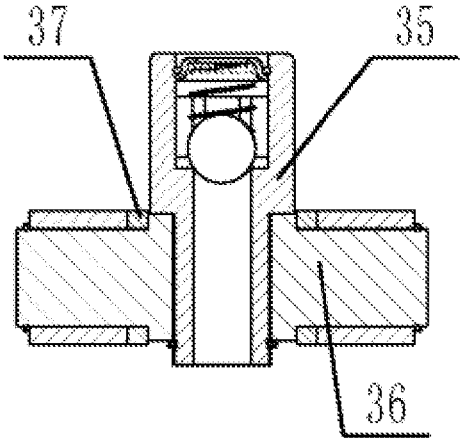
Figure 14C:
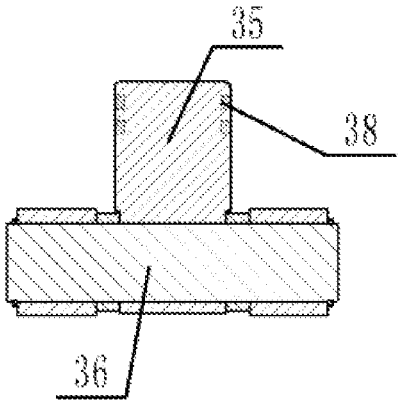
Figure 14D:
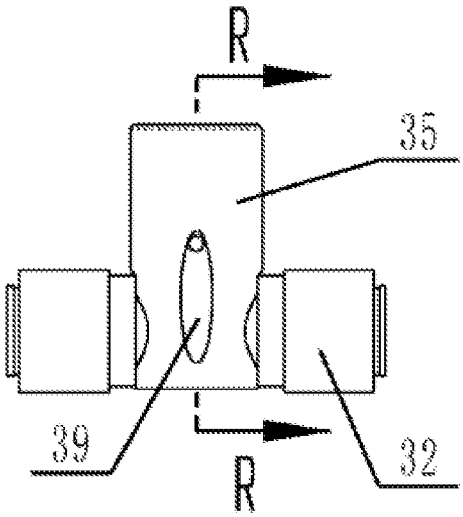
Figure 14E:
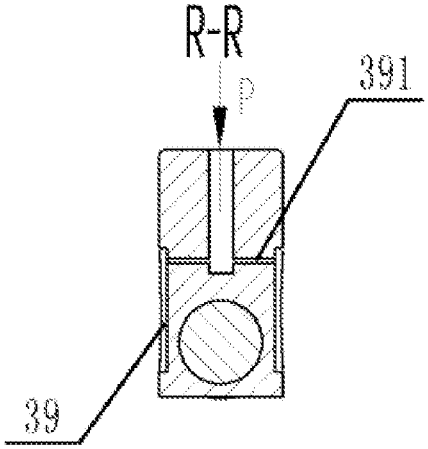
FIG. 14E is a cross-sectional view of FIG. 14D along the R-R direction.
Figure 14F:
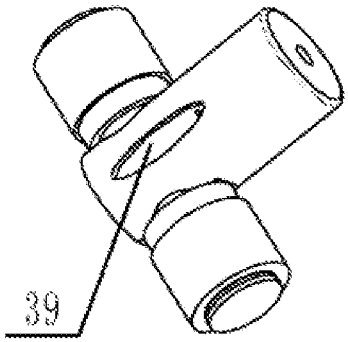
FIG. 14F is a perspective view of FIG. 14D.
Figure 15:
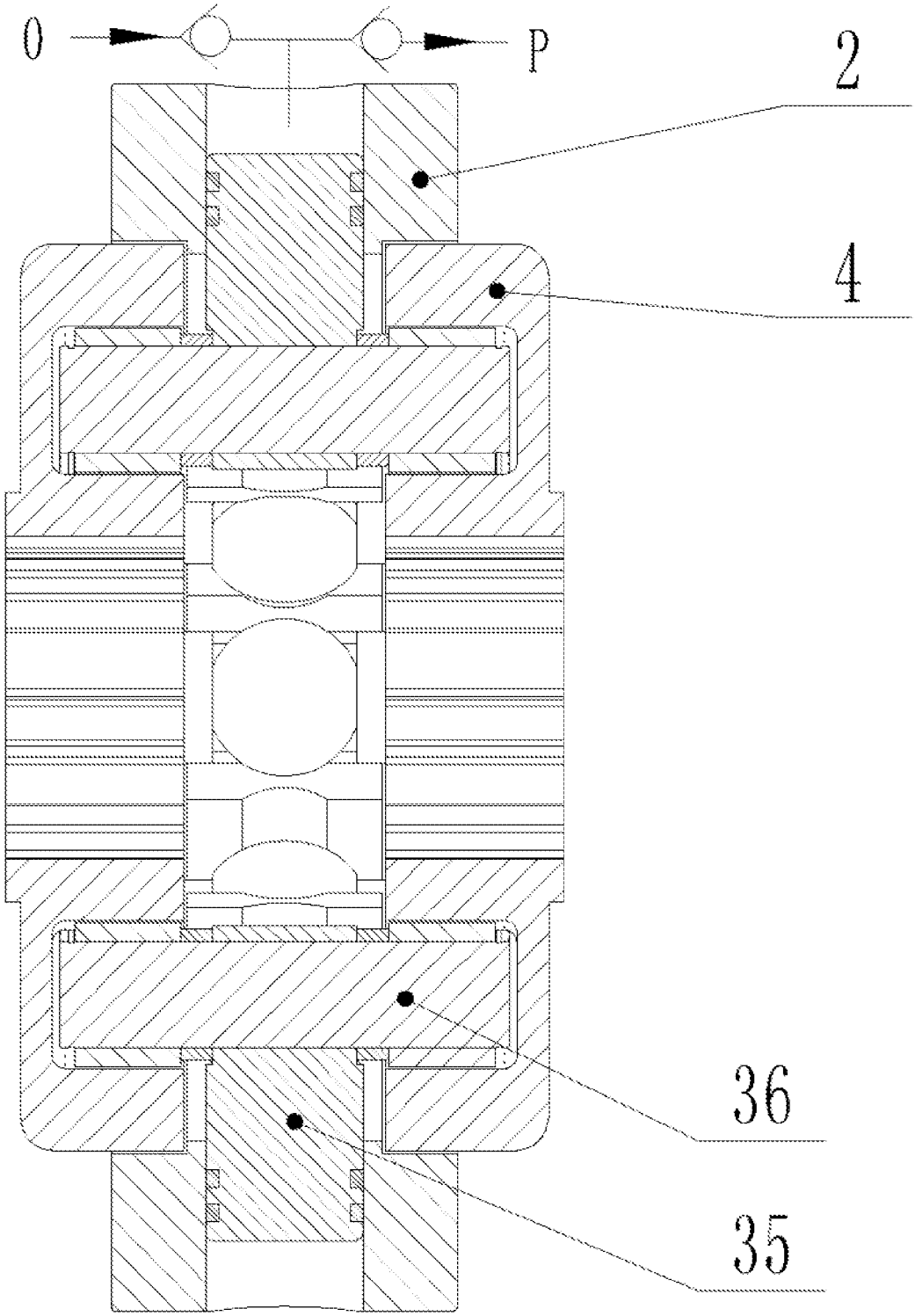
FIG. 15 is a schematic diagram of the structure assembly of the split-type piston.

FIGS. 14A-14D exemplify the structures of the split-type piston of four kinds of radial piston pumps, respectively. The piston body 35 and the supporting beam 36 are assembled together by separate manufacturing. Meanwhile, the guiding sleeve 37 is arranged separately, and the guiding sleeve is sleeved on the supporting beam of the piston. When the piston slides in the cylinder bore, the guiding sleeve can roll on the supporting surfaces of the supporting teeth, while restricting the rotation of the piston relative to the axis of the cylinder bore. FIG. 15 is a cross-sectional view of the assembly of the split-type piston, the cylinder body and the driving wheel, wherein the oil suction one-way valve and the oil discharging one-way valve are arranged on the upper part of the cylinder bore. At least one wear-resisting ring 38 to be matched with the cylinder bore is provided on the part of the piston that is matched with the cylinder bore as shown in FIG. 14C. FIGS. 14D-14F show the structure of the piston with the static-pressure supporting groove 39. FIG. 14E is the cross-sectional view of FIG. 14D along the R-R direction, and FIG. 14F is a perspective view of FIG. 14D. The static-pressure supporting groove is formed at the lateral pressure bearing part of the piston, and the size, shape, and specific setting position of the static-pressure supporting groove can be designed and arranged reasonably according to the actual pressure bearing condition of the piston. The static-pressure supporting groove communicates with the hydraulic oil in the cylinder bore through the static-pressure bore 391 to lubricate the lateral pressure bearing part of the piston. In the compression stroke stage of the pump, the compressed high-pressure oil is led to the static-pressure supporting groove through the static-pressure bore, thereby generating a static-pressure support on the surface of the piston, reducing the wear of the cylinder bore caused when the piston bears the lateral pressure. Through the various changes of the above structure of the piston in cooperation with the above multiple oil dispensing mechanisms, different technical solutions of the piston pump (piston motor) can be obtained, which will not be described in detail here.

Embodiment 5

Figure 16A:
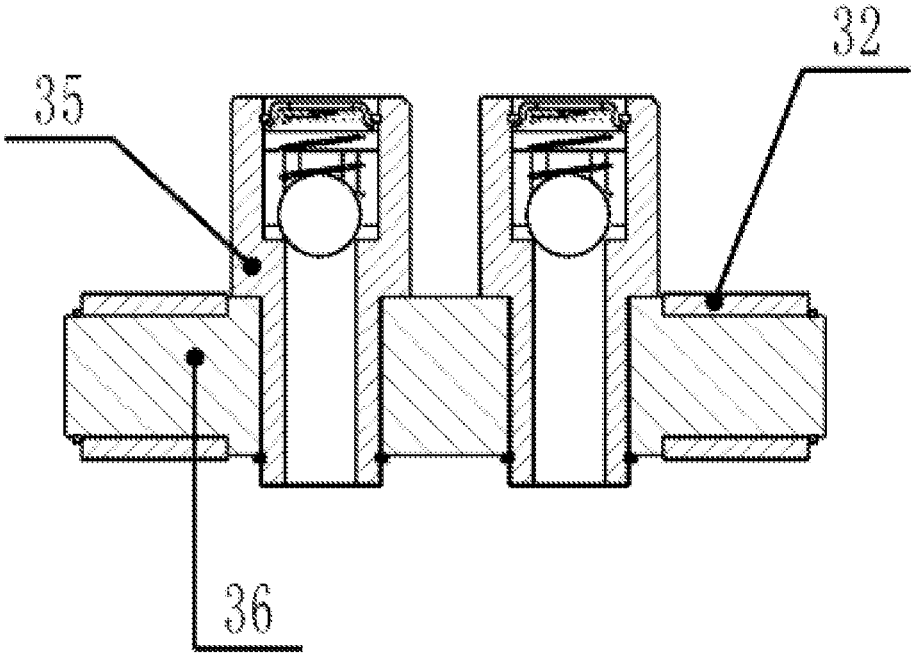
FIG. 16A and FIG. 16B are schematic diagrams showing the structure of the parallel pistons according to Embodiment 5.
Figure 16B:
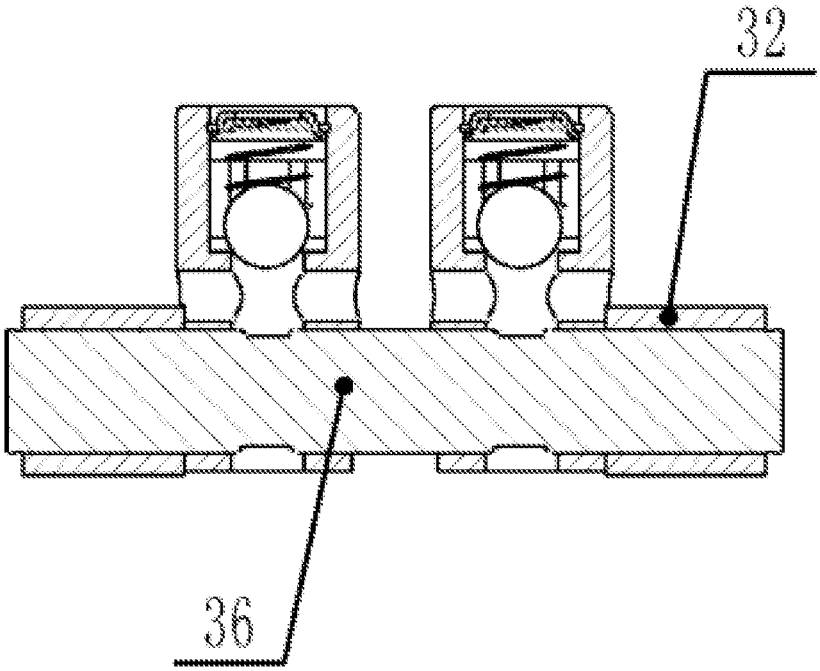
Figure 17A:
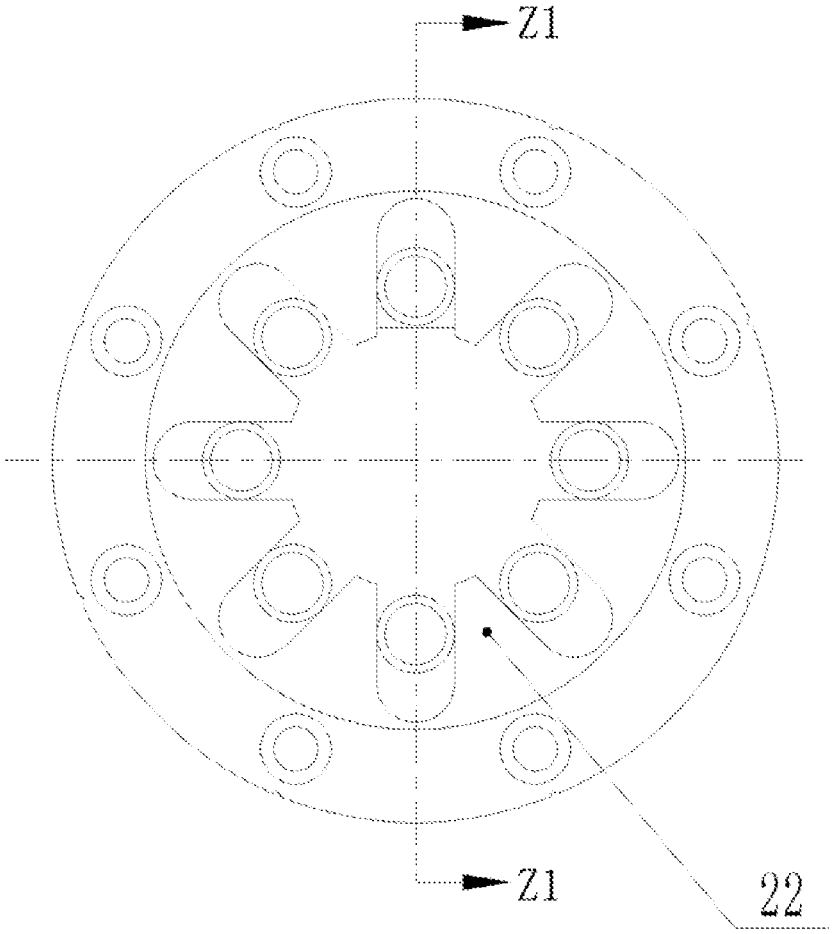
FIG. 17A is a front view of the assembly of the parallel pistons.
Figure 17B:
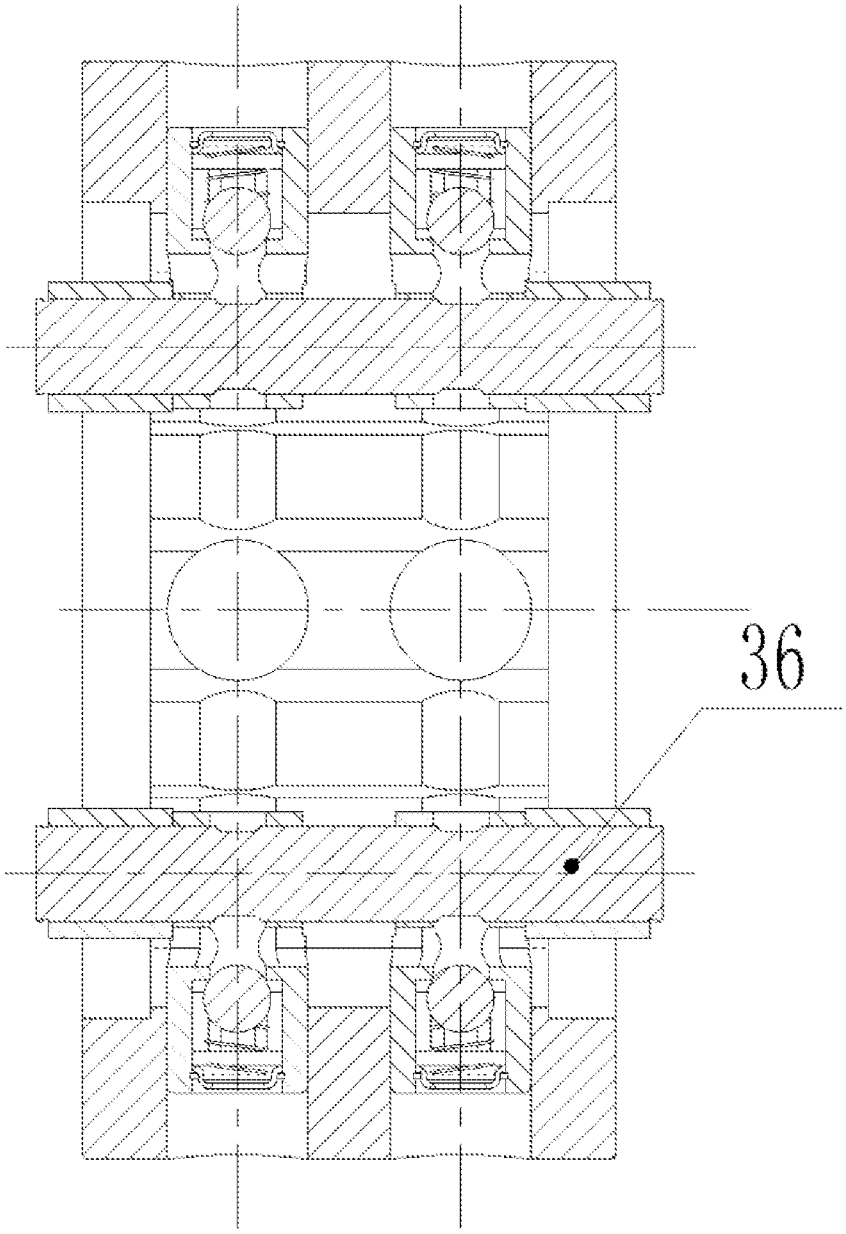
FIG. 17B is a cross-sectional view of FIG. 17A along the Z1-Z1 direction.

FIG. 16A and FIG. 16B separately exemplify the parallel structures in which at least two pistons are connected in parallel to form a group (the figures take two pistons in parallel as an example). Several pistons are connected together by the supporting beam, and correspondingly, a corresponding number of cylinder bores are arranged on the cylinder body to cooperate with the corresponding parallel pistons, respectively. As shown in FIG. 17A and FIG. 17B, FIG. 17A is a front view of the parallel pistons matched with the cylinder body, and FIG. 17B is a cross-sectional view of FIG. 17A along the Z1-Z1 direction. Through the above structure change of the piston in cooperation with the above multiple oil dispensing mechanisms, different technical solutions of the piston pump (piston motor) can be obtained, which will not be described in detail here.

Embodiment 6

Figure 18:
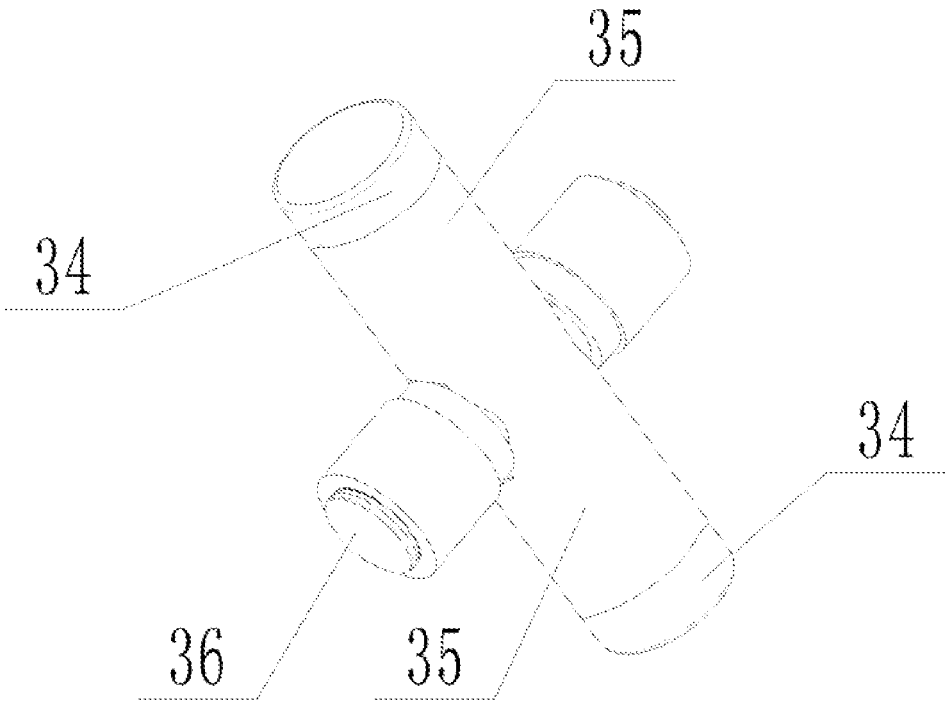
FIG. 18 is a schematic diagram of the structure of the double-acting piston according to Embodiment 6.
Figure 19A:
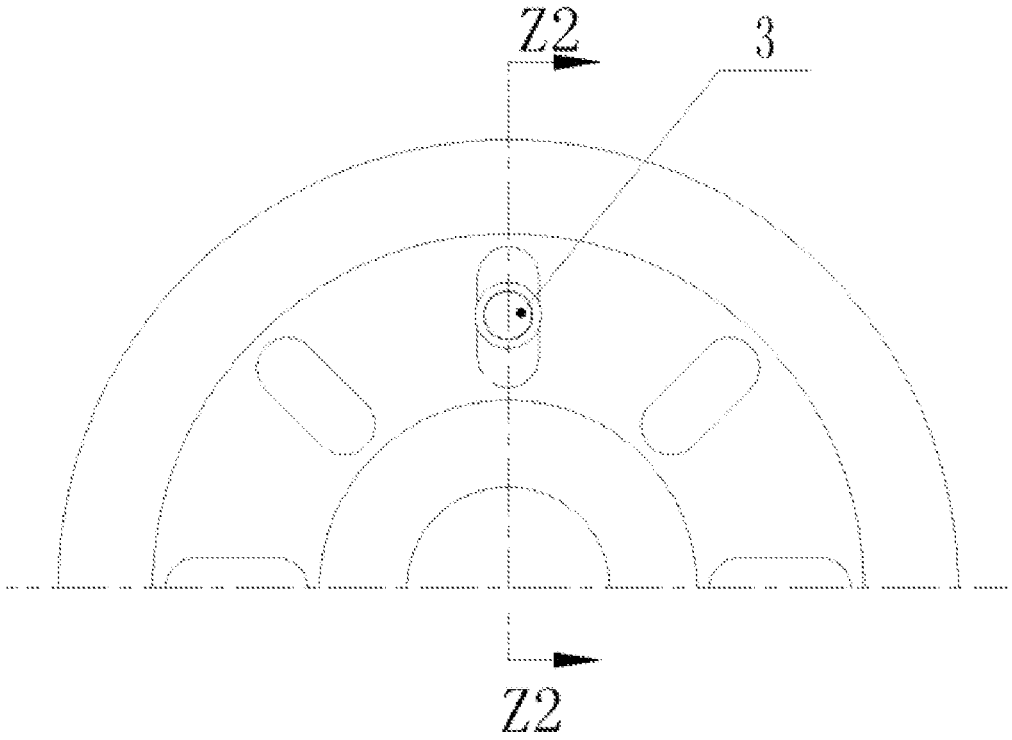
FIG. 19A is a schematic diagram of the assembly of the double-acting piston.
Figure 19B:
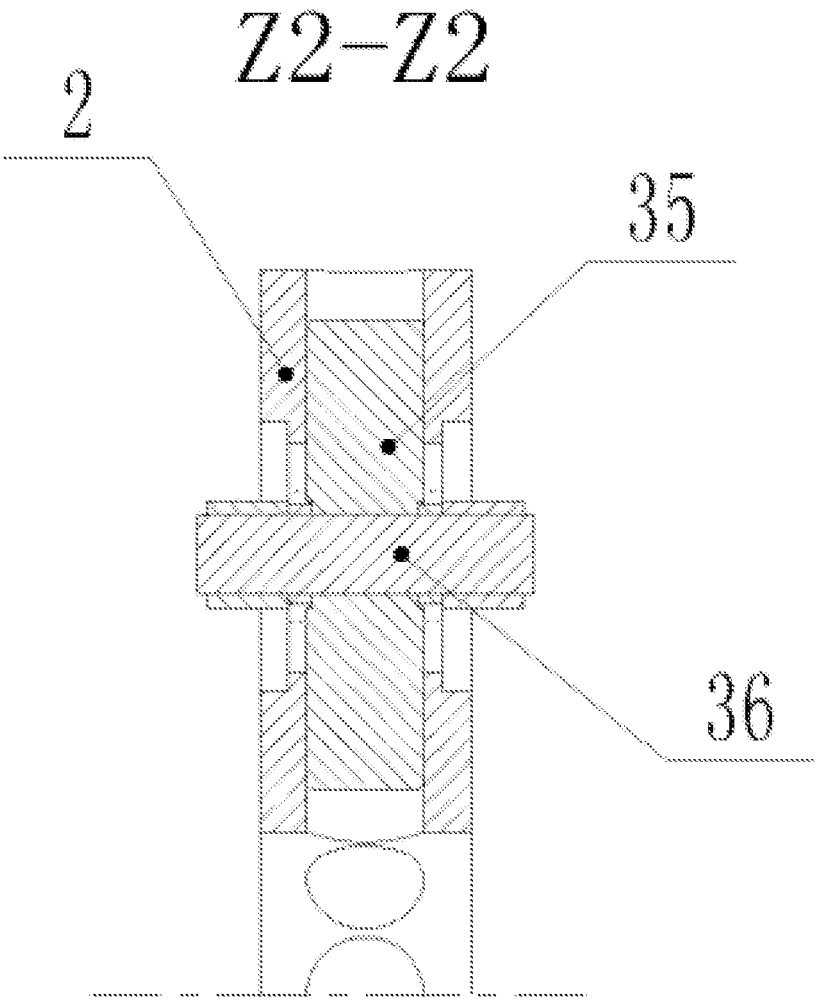
FIG. 19B is a cross-sectional view of FIG. 19A along the Z2-Z2 direction.

FIG. 18 exemplifies the double-acting structure of the piston of the radial piston pump. Two sliding engaging surfaces 34 are arranged on both sides of the supporting beam, respectively, and correspondingly, the cylinder bores on the cylinder body are arranged radially on the two sides of the corresponding supporting teeth and cooperate with the two sliding engaging surfaces of the piston, respectively. The supporting beam of the piston penetrates the groove of the supporting teeth. The guiding sleeve is sleeved on the supporting beam, is fitted in the groove of the supporting teeth, and can roll along the length of the groove. As shown in FIG. 19A and FIG. 19B, FIG. 19A is a front view of the piston with the double-acting structure that is matched with the cylinder body, and FIG. 19B is a cross-sectional view of FIG. 19A along the Z2-Z2 direction. When the driving wheel drives the piston to slide back and forth in the cylinder bore by the roller and the supporting beam, the piston can apply work twice in one operating cycle, which will not be described in detail here.

Embodiment 7

Figure 20:
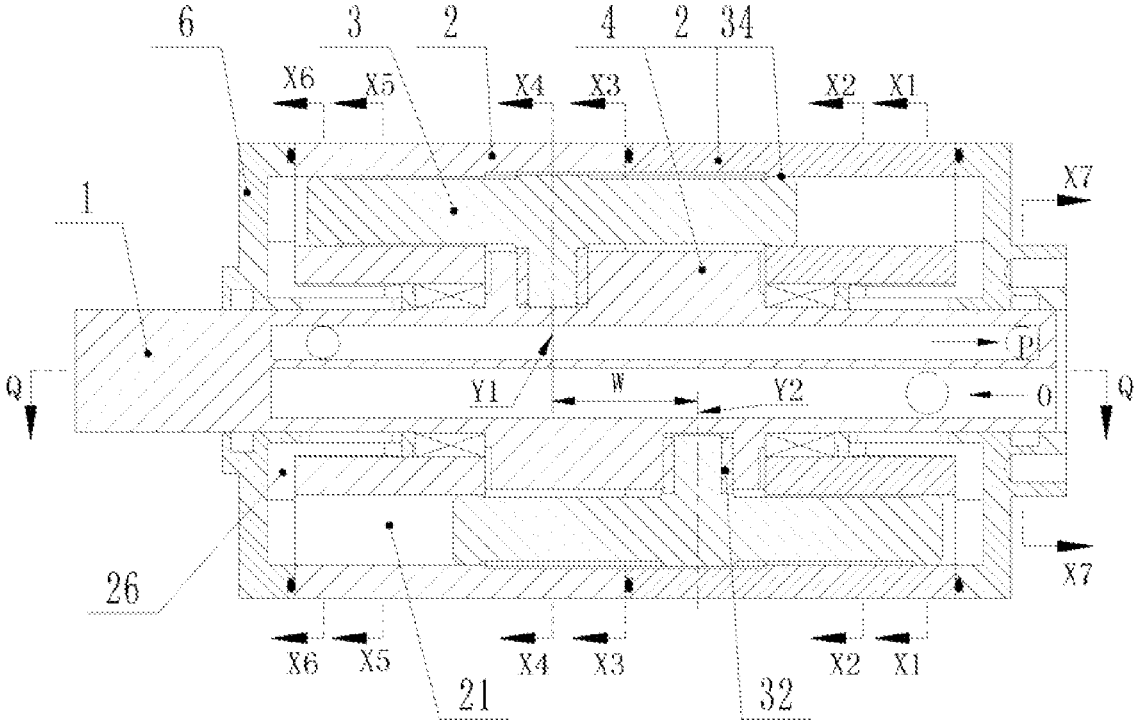
FIG. 20 is a schematic diagram of the structure according to Embodiment 7.
Figure 21:
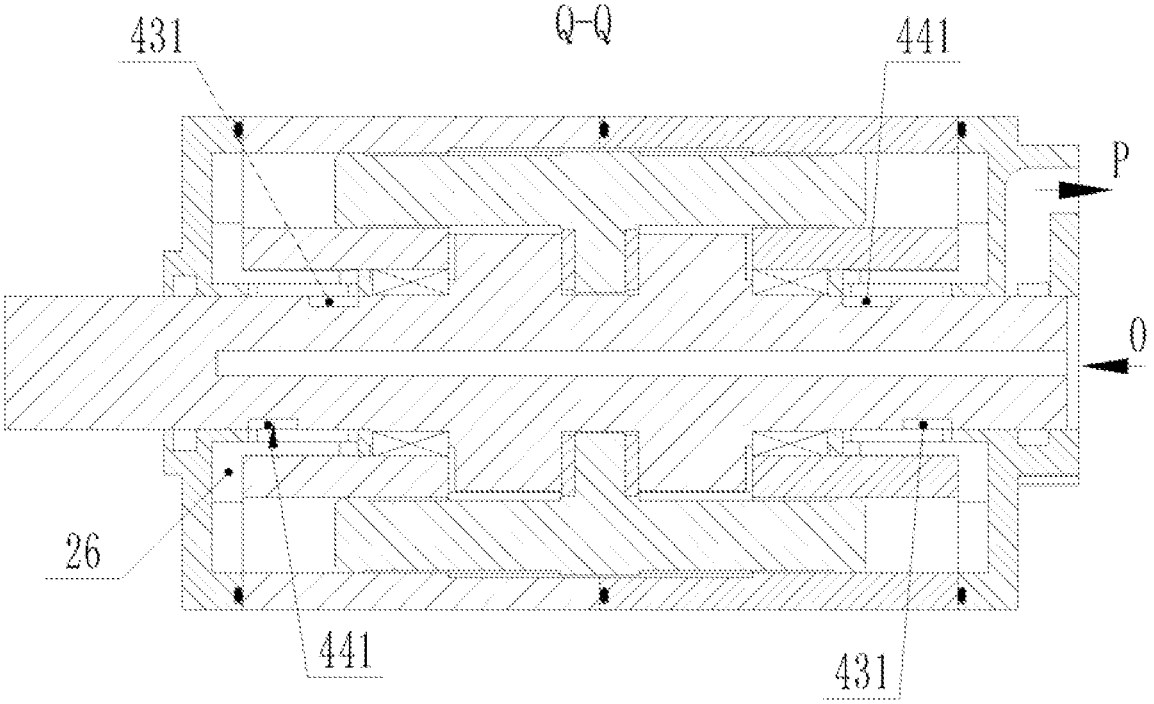
FIG. 21 is a cross-sectional view of FIG. 20 along the Q-Q direction.
Figure 22A:
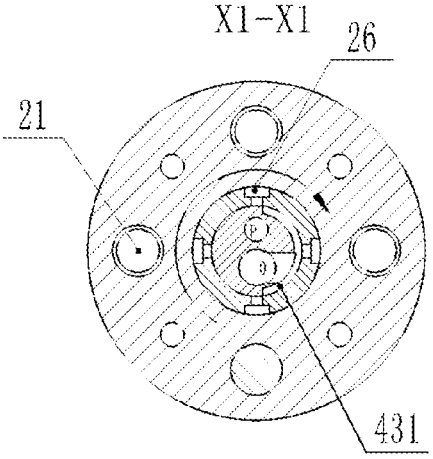
FIG. 22A is a cross-sectional view of FIG. 20 along the X1-X1 direction.
Figure 22B:
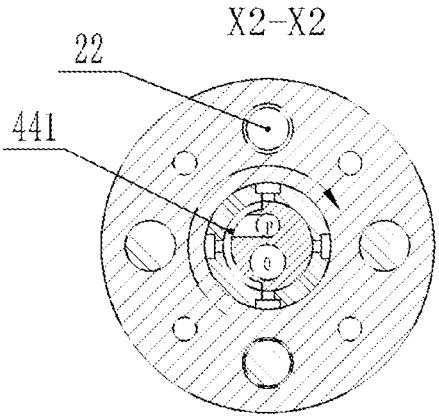
FIG. 22B is a cross-sectional view of FIG. 20 along the X2-X2 direction.
Figure 22C:
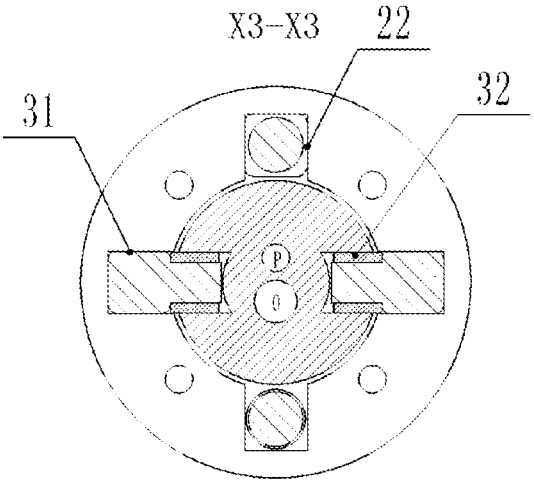
FIG. 22C is a cross-sectional view of FIG. 20 along the X3-X3 direction.
Figure 22D:
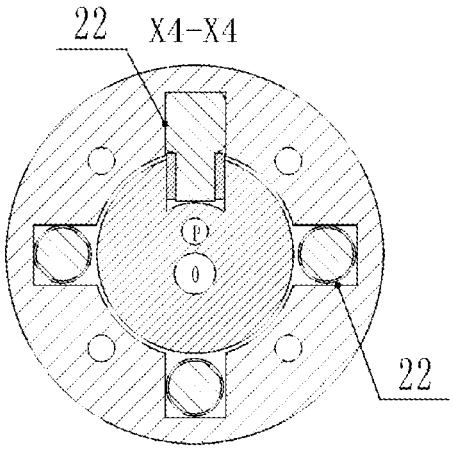
FIG. 22D is a cross-sectional view of FIG. 20 along the X4-X4 direction.
Figure 22E:
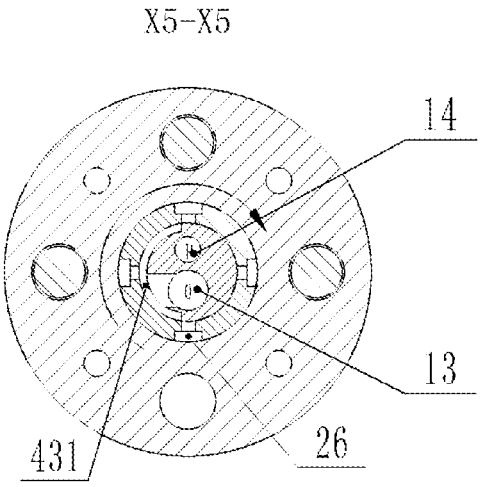
FIG. 22E is a cross-sectional view of FIG. 20 along the X5-X5 direction.
Figure 22F:
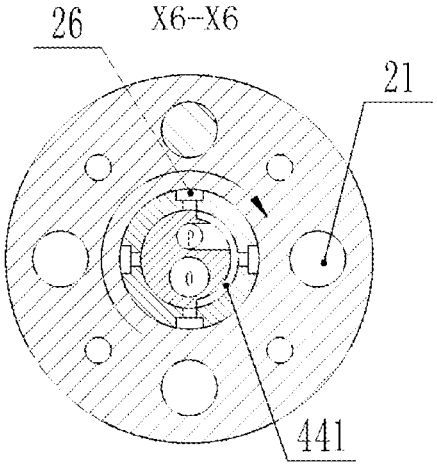
FIG. 22F is a cross-sectional view of FIG. 20 along the X6-X6 direction.

FIG. 20 is a front view according to Embodiment 7. Compared with the above piston pump, in Embodiment 4, the piston is arranged in an axial direction, and as an example, two cylinder bodies with a total of eight cylinder bores are left-to-right symmetrically arranged. This arrangement can form eight operating units. As shown in the structure of the piston in FIG. 24, the piston has a double-acting structure, and two sliding engaging surfaces with left-to-right symmetry are matched with the cylinder bores with left-to-right symmetry, respectively. The guiding surface of the piston slides in the key groove formed by the supporting teeth to guide and support the movement of the piston, as shown in FIG. 22C and FIG. 22D. In the present embodiment, the driving groove of the driving wheel is integrated on the main shaft. As shown in the schematic diagram of the structure of the main shaft in FIG. 24, the driving groove is a closed groove, which is formed on the surface of the main shaft and circumferentially surrounds the main shaft. The width and depth of the driving groove are adapted to that of the roller of the piston, and the roller of the piston can roll in the driving groove. The driving groove has two extreme positions Y1 and Y2 in the axial direction. As shown in FIG. 20, the two pistons shown in the figure exactly move to the extreme positions. FIG. 21 shows the state of the other two pistons at the midpoint of the stroke. When the main shaft rotates one cycle, the driving groove can drive the roller to complete one reciprocating cycle between Y1 and Y2, to further drive the piston to complete one reciprocating movement in the cylinder bore, and each of the corresponding left and right operating units completes one oil suction and discharging process. The distance W between Y1 and Y2 is the stroke of the piston pump.

Figure 23:
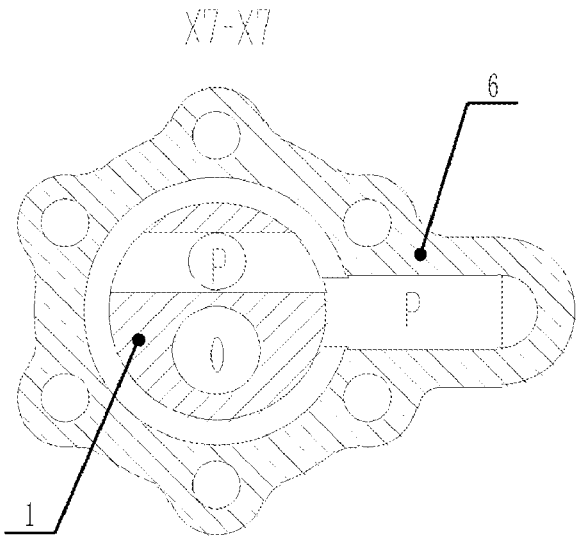
FIG. 23 is a cross-sectional view of FIG. 20 along the X7-X7 direction.
Figure 24:
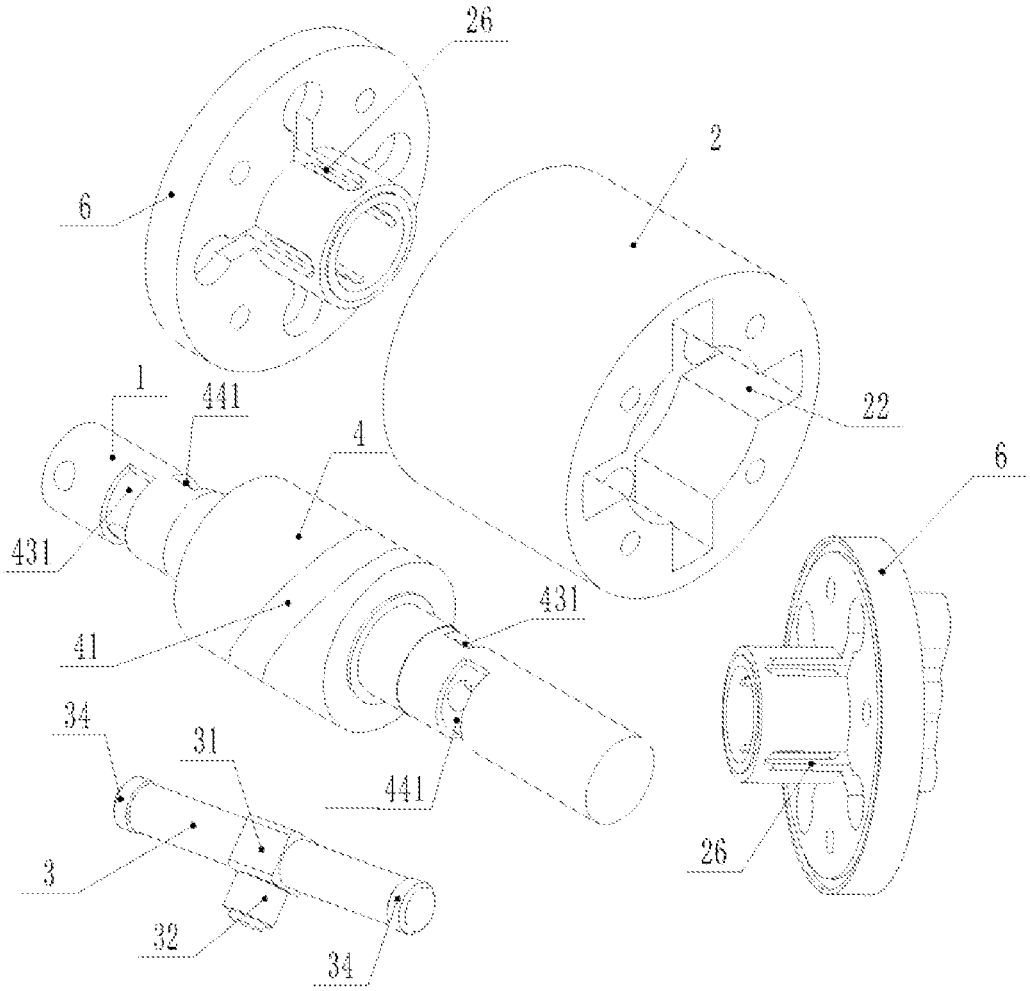
FIG. 24 is a partial exploded view according to Embodiment 7.

The oil dispensing mechanism of the present embodiment adopts a dispensing-by-shaft mode. As shown in FIG. 24, the oil suction groove 431 and the oil discharging groove 441 are arranged on the main shaft, and communicate with the pump oil suction opening and the pump oil discharging opening through the internal oil channel of the main shaft, respectively, as shown in FIG. 21 and FIG. 23. The cylinder oil channel 26 is correspondingly arranged on the end cover and communicates with the corresponding cylinder bore, as shown in FIG. 20, FIG. 21, and FIG. 24. When the main shaft rotates, the oil suction groove and the oil discharging groove timely communicate with the corresponding cylinder bore through the corresponding cylinder oil channel to cooperate with the corresponding operating unit to complete the oil suction and discharging process. FIG. 22A, FIG. 22B, FIG. 22E, FIG. 22F separately show the on/off-state of the communication between the oil suction groove and the oil discharging groove and the cylinder oil channel of each corresponding operating unit at the operating moment of FIG. 20. The rotation direction of the main shaft is clockwise. The principle of oil suction and discharging is similar to that of Embodiment 3, which will not be described in detail here.

Figure 25:
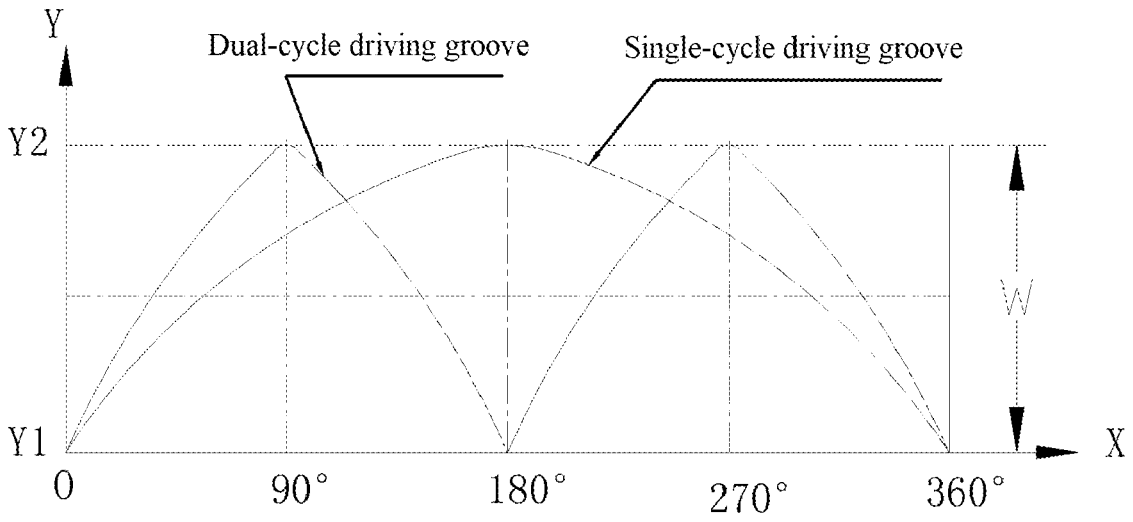
FIG. 25 is a schematic diagram of the forming principle of the driving groove in FIG. 20.

The driving groove can be formed in a plurality of manners. FIG. 25 exemplifies the forming principles of two types of driving grooves. Assuming that the driving groove is formed by machining through a key groove cutter, the key groove cutter starts from the origin point and cuts from the radial direction of the main shaft. In addition to the rotation of the cutter itself, the cutter further includes the uniform rotation around the main shaft (X-axis represents the rotation angle) and the uniform movement along the axial direction of the main shaft (Y-axis represents the movement distance in the axial direction). The result of the XY compound movement forms the curve in the figure, which represents the trajectory of the cutter around the surface of the main shaft, thereby forming the corresponding driving groove. Y1 and Y2 represent the two extreme positions of the driving groove in the axial direction, W is the axial distance and determines the size of the drive stroke of the driving groove, and the number of cycles of the curve determines the number of cycles of oil suction and discharging that the operating unit can complete in one rotational cycle of the main shaft. The number of cycles of the single-cycle driving groove and the number of cycles of the dual-cycle driving groove in the exemplary figure are one and two, respectively, and thus, the operating unit can complete one cycle and two cycles of oil suction and discharging in one rotational cycle of the main shaft, respectively. The number of cycles of the driving groove can be arranged reasonably as needed, and the oil suction groove and the oil discharging groove with the same number of cycles that are adapted to the driving groove are arranged correspondingly. The setting principle is similar to that of Embodiment 3 (the driving groove of Embodiment 3 has five cycles), which will not be described in detail here.

The number of cylinder bores can be increased or decreased as needed. It is not necessary to set two groups that have left-to-right symmetry, while only one group is set. Alternatively, multiple groups can be arranged in series to form a multiplex pump.

When the oil supply method is changed in the present embodiment, for example, if the oil opening P is used as the oil inlet opening and the oil opening O is used as the oil returning opening, the piston pump of the present embodiment can also be used as a motor. The operating principles thereof are exactly opposite to that of the above-mentioned pump, and will not be described in detail here.

Embodiment 8

Figure 26:
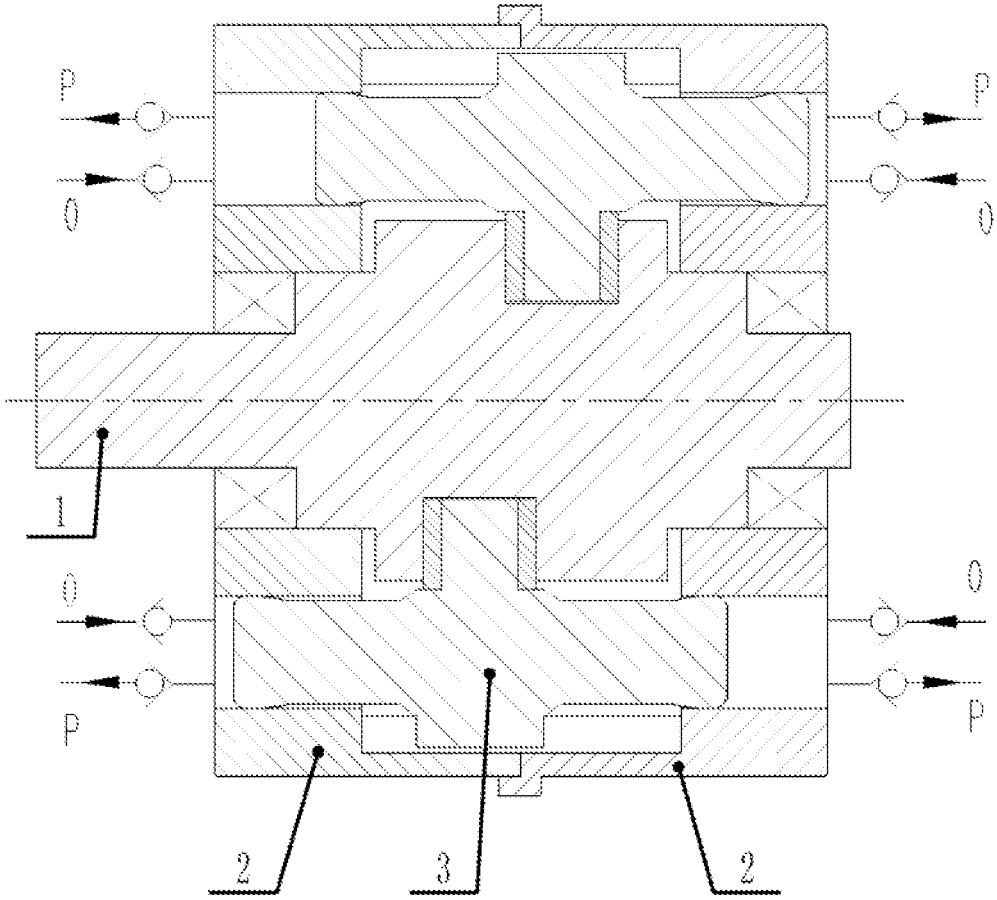
FIG. 26 is a schematic diagram of the structure according to Embodiment 8.

FIG. 26 is a schematic diagram according to the present embodiment, compared with Embodiment 7, the main differences are: both the oil suction mechanism and the oil discharging mechanism of the present embodiment adopt a dispensing-by-valve mode, that is, two one-way valves corresponding to each operating unit are arranged in opposite directions to automatically control the oil suction and discharging of each cylinder bore. The operating principles are similar to that of Embodiment 1, and will not be described in detail here.

Embodiment 9

Combining Embodiments 7 and 8, the oil dispensing mechanism of Embodiment 7 can also be arranged as that a dispensing-by-valve mode is used for the oil suction and dispensing, and a dispensing-by-shaft mode is used for the oil discharging and dispensing; alternatively, the dispensing-by-shaft mode is used for the oil suction and dispensing, and the dispensing-by-valve mode is used for the oil discharging and dispensing. The operating principles are similar to that of the above embodiments, and will not be described in detail here.

Embodiment 10

Figure 27A:
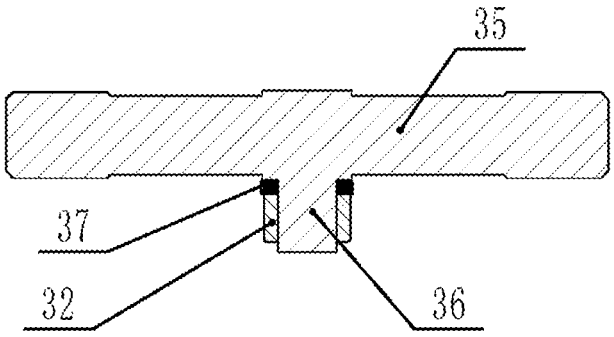
FIG. 27A is a schematic diagram of the installation of the guiding sleeve in an integral piston.
Figure 27B:
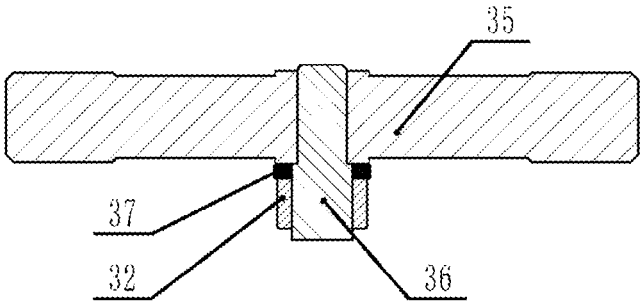
FIG. 27B is a schematic diagram of the installation of the guiding sleeve in a split-type piston.
Figure 28:
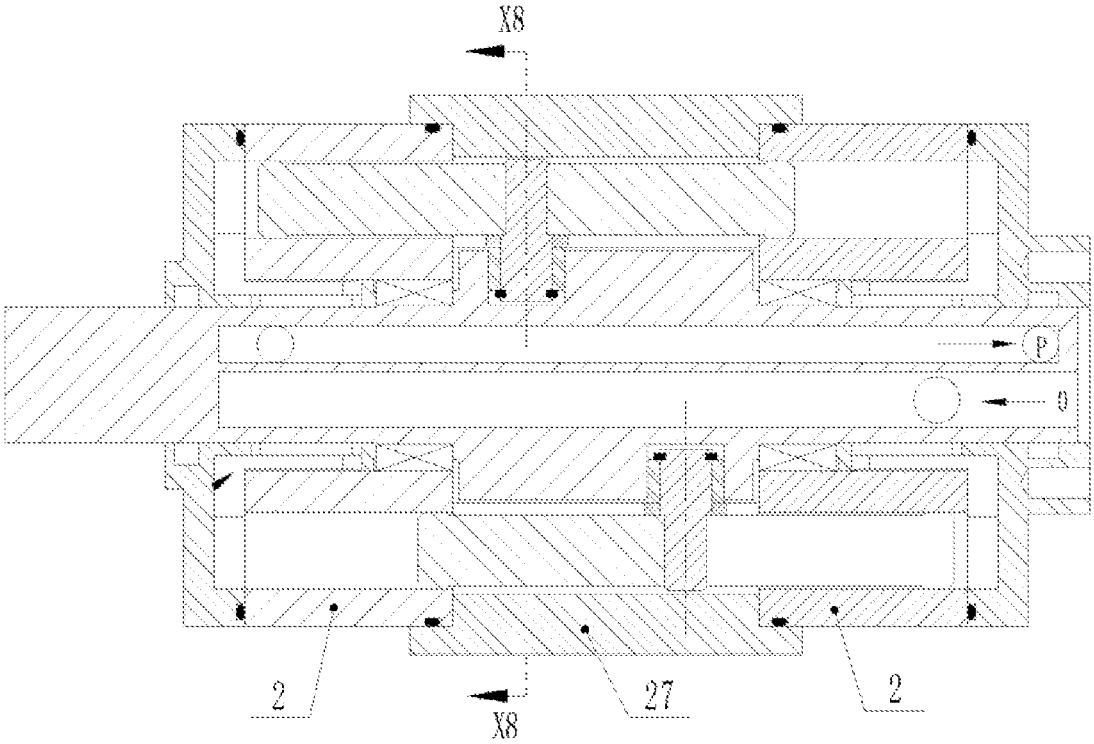
FIG. 28 is a schematic diagram of the structure according to Embodiment 10.
Figure 29:
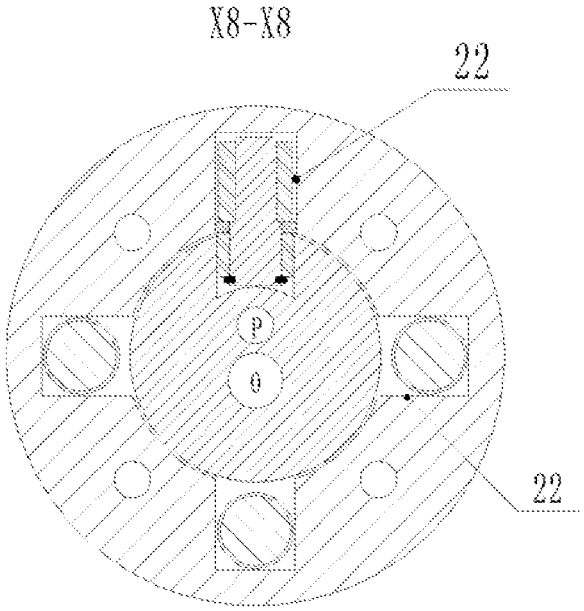
FIG. 29 is a cross-sectional view of FIG. 28 along the X8-X8 direction.

As shown in FIGS. 27-29, in the present embodiment, the left cylinder body and the right cylinder body are connected together by providing the cylinder body sleeve 27, and the supporting teeth are arranged on the cylinder body sleeve, thereby simplifying the manufacturing process of the cylinder body.

The structure of the piston can also be changed as needed. FIG. 27A and FIG. 27B preferably illustrate the structures of two kinds of split-type pistons. The guiding surface of the original integral piston is transferred to a guiding sleeve arranged separately, and the guiding sleeve is sleeved on the supporting beam of the piston. When the piston slides in the cylinder bore, the guiding surface of the guiding sleeve can roll on the supporting surfaces of the supporting teeth, while restricting the rotation of the piston relative to the axis of the cylinder bore, as shown in FIG. 28 and FIG. 29.

It should be noted that the above are only preferred specific embodiments of the present invention, but the scope of protection of the present invention is not limited thereto. Obviously, as needed, it is also possible to extract or refer to the technical features, technical methods, and technical concepts shown in the above embodiments for optimizing the arrangement and combination to obtain other solutions, which will not be described exhaustively here. Those having ordinary skill in the art may make equivalent replacements or changes according to the embodiments and inventive concept of the present invention within the technical scope disclosed by the present invention, for example: changing the number or arrangement direction of cylinder bores, changing the shape of the driving wheel, changing the shape of the driving groove, changing the position, number or shape of the oil channel, changing the communication manner of the oil channel, changing the form, number and arrangement of the one-way valve, etc., but all of those equivalent replacements or changes shall fall within the scope of protection of the present invention.

In the description of the present invention, it should be noted that the terms "front end", "rear end", "left-to-right", "upper", "lower", "horizontal" and others indicated the orientation or positional relationship are based on the orientation or positional relationship shown in the drawings, only facilitating the description of the present invention and simplifying the description, which does not indicate or imply that the indicated device or element must have a specific orientation, be constructed and operated in a specific orientation, and thus cannot be understood as limiting the present invention.

In the description of the present invention, it should also be noted that unless otherwise clearly specified and limited, the terms "arrange/set/provide", "mount", "connect" and "communicate" should be interpreted broadly. For example, "connect" can be a fixed connection, a detachable connection, or an integrated connection; or it can be a mechanical connection, or an electrical connection; or it can be a direct connection, an indirect connection through an intermediate medium, or an internal communication between two components. For those having ordinary skill in the art, the specific meanings of the above-mentioned terms in the present invention can be understood according to specific situations.

Certainly, the above contents are only preferred embodiments of the present invention, and cannot be considered as limiting the scope of the present invention. The present invention is not limited to the above examples, and equal changes and improvements made by those having ordinary skill in the art within the essential scope of the present invention shall fall within the scope of protection of the present invention.

What is claimed is:

1. A piston pump, comprising a cylinder body, a piston, a main shaft, and an oil dispensing mechanism; wherein the cylinder body is arranged coaxially with the main shaft and is fixed in place relative to the main shaft by a housing mounted outside the cylinder body, and an end cover; the piston is reciprocally mounted in a cylinder bore of the cylinder body, and is configured to move along the cylinder bore; opposing axial ends of the cylinder body are sealed by the end cover; the oil dispensing mechanism comprises an oil suction mechanism and an oil discharging mechanism; a roller is mounted on the piston, and the roller is rotatablely connected to the piston; a driving wheel is arranged on the main shaft; the driving wheel is mounted in cooperation with the main shaft, or the driving wheel is integrally formed with the main shaft; and a driving groove is formed on the driving wheel, and a roller-path surface of the driving groove is a curved surface; a size of the driving groove is adapted to an outer diameter of the roller; the main shaft rotates to drive the driving wheel to rotate to further drive the piston-to move along the cylinder bore.

2. The piston pump of claim 1, wherein the oil suction mechanism employs a first dispensing-by-valve mode or a first dispensing-by-shaft mode, and the oil discharging mechanism employs a second dispensing-by-valve mode or a second dispensing-by-shaft mode.

3. The piston pump of claim 2, wherein the first dispensing-by-valve mode of the oil suction mechanism is to mount an oil suction one-way valve in the piston, and the second dispensing-by-valve mode of the oil discharging mechanism is to mount an oil discharging one-way valve at an oil discharging opening.

4. The piston pump of claim 1, wherein supporting teeth are arranged on an inner surface of the cylinder body; the supporting teeth are configured to guide the piston between corresponding supporting teeth, and the piston is configured to move along surfaces of the supporting teeth.

5. The piston pump of claim 4, wherein a direction of the cylinder bore is perpendicular to a direction of a center line of the cylinder body; the piston is configured to move radially along the cylinder body; the driving wheel is mounted symmetrically on both sides of the cylinder body, and the driving wheel comprises a left driving wheel and a right driving wheel according to an installation position; the driving groove of the driving wheel includes an inner roller-path surface and an outer roller-path surface; the inner roller-path surface and the outer roller-path surface are continuous surfaces; each of the continuous surfaces is smoothly connected end-to-end and is provided with a periodic undulation formed by convex portions and concave portions, wherein the convex portions and the concave portions are uniformly circumferentially distributed at intervals; the inner roller-path surface and the outer roller-path surface are concentrically nested together at an equal spacing, and a size of the spacing is adapted to the outer diameter of the roller; the roller comprises a left roller and a right roller left-to-right symmetrically arranged on both sides of the piston, and the left roller and right roller are correspondingly separately fitted in the driving groove of each of the left driving wheel and the right driving wheel; each roller is clamped between the inner roller-path surface and the outer roller-path surface to roll along the driving groove; the housing is provided with an oil discharging opening; the main shaft is supported on the housing, the end cover, or the cylinder body through a bearing.

6. The piston pump of claim 4, wherein a direction of the cylinder bore is parallel to a direction of a center line of the cylinder body, and the cylinder body is left-to-right symmetrically arranged and comprises a left cylinder body and a right cylinder body, and the cylinder bore of the left cylinder body and the cylinder bore of the right cylinder body are communicated in one-to-one correspondence; the piston is configured to move in the cylinder bore of the left cylinder body and the cylinder bore of the right cylinder body; the piston together with the cylinder bore of the left cylinder body and the cylinder bore of the right cylinder body forms two operating chambers to perform an oil suction and-an oil discharging at a same time; when a first operating chamber of the two operating chambers is configured to perform the oil suction, a second operating chamber of the two operating chambers is configured to perform the oil discharging; the two operating chambers are configured to alternately apply work to complete the oil suction and the oil discharging; both ends of the housing are sealed by the end cover; an oil suction opening and an oil discharging opening are arranged on the main shaft, and the oil suction opening and the oil discharging opening communicate with the cylinder bore of the left cylinder body and the cylinder bore of the right cylinder body, respectively; the driving wheel and the main shaft are integrally formed; a position of the driving groove corresponds to the supporting teeth; the driving groove is a closed groove circumferentially surrounding the driving wheel, and a width and a depth of the driving groove are adapted to the roller; the roller is located on a side of the piston, and the roller is configured to move along the driving groove.

7. The piston pump of claim 6, wherein a cylinder body sleeve is mounted between the left cylinder body and the right cylinder body; the supporting teeth are arranged on the cylinder body sleeve, or the supporting teeth are arranged on the left cylinder body and the right cylinder body.

8. The piston pump of claim 1, wherein the piston comprises a supporting beam and a piston body; the piston body and the supporting beam are perpendicular to form a T-shape or a cross-shape; the piston body and the supporting beam are assembled by connecting each other or are integrally formed, and the roller is mounted on the supporting beam.

9. The piston pump of claim 8, wherein a guiding sleeve is arranged on the supporting beam; when the piston moves in the cylinder bore, the guiding sleeve moves along the supporting teeth to reduce a wear on the supporting beam.

10. The piston pump of claim 8, wherein a wear-resisting ring is arranged at an upper end of the piston body; a static-pressure supporting groove is formed on a side of the piston, and the static-pressure supporting groove communicates with the cylinder bore through a static-pressure bore.

11. The piston pump of claim 2, wherein the driving wheel comprises a left driving wheel and a right driving wheel, the first dispensing-by-shaft mode of the oil suction mechanism is to arrange an oil suction groove on an outer circular surface of the left driving wheel; the oil suction groove communicates with an inner chamber of the piston pump; a cylinder oil suction channel corresponding to the cylinder bore is arranged at an inner circular surface of the cylinder body; a housing oil channel is formed in the housing; and the cylinder oil suction channel communicates with the cylinder bore through the housing oil channel.

12. The piston pump of claim 2, wherein the driving wheel comprises a left driving wheel and a right driving wheel, the second dispensing-by-shaft mode of the oil discharging mechanism is that oil discharging grooves are arranged correspondingly and uniformly on an outer circular surface of the right driving wheel; the outer circular surface of the right driving wheel is matched with an inner circular surface of the cylinder body; a first cylinder oil discharging channel and a second cylinder oil discharging channel are uniformly arranged on the cylinder body, and the first cylinder oil discharging channel and the second cylinder oil discharging channel correspond to the cylinder bore; the right driving wheel is configured to switch on/off a connection between the first cylinder oil discharging channel and the second cylinder oil discharging channel through the outer circular surface of the right driving wheel and the oil discharging grooves; when the oil discharging grooves on the outer circular surface of the right driving wheel run to a position aligned with the first cylinder oil discharging channel and the second cylinder oil discharging channel, the first cylinder oil discharging channel and the second cylinder oil discharging channel are connected through the oil discharging grooves to realize an oil discharging of the piston pump; when the oil discharging grooves on the outer circular surface of the right driving wheel do not run to the position aligned with the first cylinder oil discharging channel and the second cylinder oil discharging channel, an oil opening of the first cylinder oil discharging channel and an oil opening of the second cylinder oil discharging channel are closed by the outer circular surface of the right driving wheel, the connection between the first cylinder oil discharging channel and the second cylinder oil discharging channel is switched off, and a pump oil discharging opening is closed in cooperation with an oil suction process of the piston pump.

13. The piston pump of claim 1, wherein an oil suction groove and an oil discharging groove are arranged on the main shaft; the oil suction groove communicates with a pump oil suction opening through an oil suction channel inside the main shaft, and the oil discharging groove communicates with a pump oil discharging opening through an oil discharging channel inside the main shaft; a cylinder oil channel is arranged on the end cover, and the cylinder oil channel communicates with the cylinder bore corresponding to the cylinder oil channel; when the main shaft rotates, the oil suction groove communicates with the cylinder bore corresponding to the oil suction groove through the cylinder oil channel corresponding to the oil suction groove, the oil discharging groove communicates with the cylinder bore corresponding to the oil discharging groove through the cylinder oil channel corresponding to the oil discharging groove, and the oil suction groove and the oil discharging groove cooperate with each other to complete an oil suction and an oil discharging.

14. The piston pump of claim 1, wherein the piston pump is operated as a piston motor such that a pump oil discharging opening of the piston pump is used as an oil inlet opening of the piston motor, wherein a high-pressure oil is pumped into the oil inlet opening of the piston motor; a dispensing-by-shaft mode of the piston pump is used to control the high-pressure oil to enter the cylinder bore and drive the piston to move in the cylinder bore to further drive the main shaft to rotate and output power; a pump oil suction opening of the piston pump is used as an oil returning opening of the piston motor, and the dispensing-by-shaft mode or a dispensing-by-valve mode of the piston pump is used to cooperate with a movement of the piston to control an oil returning of the high-pressure oil in the cylinder bore to realize a function of the piston motor.

15. The piston pump of claim 2, wherein supporting teeth are arranged on an inner surface of the cylinder body; the supporting teeth are configured to guide the piston between corresponding supporting teeth, and the piston is configured to move along surfaces of the supporting teeth.

16. The piston pump of claim 3, wherein supporting teeth are arranged on an inner surface of the cylinder body; the supporting teeth are configured to guide the piston between corresponding supporting teeth, and the piston is configured to move along surfaces of the supporting teeth.

17. The piston pump of claim 2, wherein the piston comprises a supporting beam and a piston body; the piston body and the supporting beam are perpendicular to form a T-shape or a cross-shape; the piston body and the supporting beam are assembled by connecting each other or are integrally formed, and the roller is mounted on the supporting beam.

18. The piston pump of claim 3, wherein the piston comprises a supporting beam and a piston body; the piston body and the supporting beam are perpendicular to form a T-shape or a cross-shape; the piston body and the supporting beam are assembled by connecting each other or are integrally formed, and the roller is mounted on the supporting beam.

19. The piston pump of claim 2, wherein an oil suction groove and an oil discharging groove are arranged on the main shaft; the oil suction groove communicates with a pump oil suction opening through an oil suction channel inside the main shaft, and the oil discharging groove communicates with a pump oil discharging opening through an oil discharging channel inside the main shaft; a cylinder oil channel is arranged on the end cover, and the cylinder oil channel communicates with the cylinder bore corresponding to the cylinder oil channel; when the main shaft rotates, the oil suction groove communicates with the cylinder bore corresponding to the oil suction groove through the cylinder oil channel corresponding to the oil suction groove, the oil discharging groove communicates with the cylinder bore corresponding to the oil discharging groove through the cylinder oil channel corresponding to the oil discharging groove, and the oil suction groove and the oil discharging groove cooperate with each other to complete an oil suction and an oil discharging.

20. The piston pump of claim 3, wherein an oil suction groove and an oil discharging groove are arranged on the main shaft; the oil suction groove communicates with a pump oil suction opening through an oil suction channel inside the main shaft, and the oil discharging groove communicates with a pump oil discharging opening through an oil discharging channel inside the main shaft; a cylinder oil channel is arranged on the end cover, and the cylinder oil channel communicates with the cylinder bore corresponding to the cylinder oil channel; when the main shaft rotates, the oil suction groove communicates with the cylinder bore corresponding to the oil suction groove through the cylinder oil channel corresponding to the oil suction groove, the oil discharging groove communicates with the cylinder bore corresponding to the oil discharging groove through the cylinder oil channel corresponding to the oil discharging groove, and the oil suction groove and the oil discharging groove cooperate with each other to complete an oil suction and an oil discharging.

* * * * *